US005460130A

United States Patent [19]

Fukuzawa et al.

[11] Patent Number: 5,460,130

[45] Date of Patent: Oct. 24, 1995

[54] SOHC-TYPE VALVE OPERATING SYSTEM IN INTERNAL COMBUSTION ENGINE

[75] Inventors: Masami Fukuzawa; Koichi Fukuo; Yoshihiro Fujiyoshi; Hidemi Arai; Shinichi Nishida; Chihaya Sugimoto; Takashi Sugai; Kazuaki Shimoyama; Masayuki Kobayashi, all of Saitama, Japan

[73] Assignee: Honda Giken Kogyo Kabushiki Kaisha, Tokyo, Japan

[21] Appl. No.: 183,084

[22] Filed: Jan. 18, 1994

[30] Foreign Application Priority Data

Jan. 18, 1993 [JP] Japan ..... 5-005781

[51] Int. Cl.[6] ..... F01L 13/00

[52] U.S. Cl. ..... 123/90.16; 123/90.23

[58] Field of Search ..... 123/90.15, 90.16, 123/90.17, 90.27, 90.39, 90.42, 90.44, 90.22, 90.23

[56] References Cited

U.S. PATENT DOCUMENTS

| | | | |
|---|---|---|---|
| 4,768,475 | 9/1988 | Ikemura | 123/90.16 |
| 5,101,777 | 4/1992 | Onishi et al. | 123/90.27 |
| 5,101,778 | 4/1992 | Fukuo et al. | 123/90.16 |
| 5,207,193 | 5/1993 | Sugimoto et al. | 123/90.16 |

FOREIGN PATENT DOCUMENTS

| | | |
|---|---|---|
| 0141527 | 5/1985 | European Pat. Off. . |
| 0267696 | 5/1988 | European Pat. Off. . |
| 0452158 | 10/1991 | European Pat. Off. . |

*Primary Examiner*—Henry C. Yuen
*Assistant Examiner*—Weilun Lo
*Attorney, Agent, or Firm*—Lyon & Lyon

[57] ABSTRACT

An SOHC-type valve operating system in an internal combustion engine having a single cam shaft commonly provided for a pair of intake valves and a pair of exhaust valves. A plurality of intake valve driving members are rockably disposed between the cam shaft and the pair of intake valves and have an operative-connection switchover mechanism for switching over the connection and disconnection of the intake valve driving members. A pair of exhaust valve driving members are rockably disposed between the cam shaft and the pair of exhaust valves and independently operate each of the exhaust valves. The operative-connection switchover mechanism includes a switchover pin movable between a position for operatively connecting adjacent intake valve driving members and a position for releasing such connection, which pin is slidably mounted in a cylindrical sleeve secured to the intake valve driving members for guiding the movement of the switchover pin. The cylindrical sleeve also rotatably supports a cylindrical rotor in rolling contact with a cam provided on the cam shaft. The operative-connection switchover mechanism is disposed on the opposite side of the intake valves with respect to the rocking axis of the intake valve driving member whereby space for disposing a component such as an ignition plug is available on the intake side of the engine.

9 Claims, 28 Drawing Sheets

62
10
10
46
34₁
70
45
33₁
52₂
91a
71
48
38₁
59₂
95
96
95a
91
92
75
55
60
56
36₂
69'
92a
57
68'
53₂
47
35₁
54₂
73
94a
72
48
60
38₁
59₂
94
93
93a
26
32
31
29
30
32

13
13
62
46
47
48
48
45
$34_1$
$35_1$
$33_1$
$53_3$
$54_3$
$52_3$
$38_1$
$38_1$
$59_3$
$59_3$
103
97
98
104
72
71
70
$68'$
$69'$
106
93
102
$36_2$
56
92
105
55
91
101
57
60
60
26
32
32
31
29
30

SOHC-TYPE VALVE OPERATING SYSTEM IN INTERNAL COMBUSTION ENGINE

BACKGROUND OF THE INVENTION

Field of the Invention

The present invention relates to an SOHC-type valve operating system in an internal combustion engine having a single cam shaft commonly provided for a pair of intake valves and a pair of exhaust valves, a plurality of intake valve driving members rockably disposed between the cam shaft and the pair of intake valves and having an operative-connection switchover mechanism for switching over the connection and disconnection, and a pair of exhaust valve driving members rockably disposed between the cam shaft and the pair of exhaust valves and independently corresponding to each of the exhaust valves.

Description of the Prior Art

Conventionally such a valve operating system has been known as disclosed, for example, from Japanese Patent Application Laid-open No. 1405/92.

Such a conventional valve operating system includes three valve side rocker arms, two of which are operatively connected, at their one ends, to a pair of intake valves. Rollers in rolling contact with a cam are rotatably supported on the other ends of the rocker arms, so as to reduce frictional loss. However, since an operative-connection switchover mechanism having a rocker arm is provided between one end of the rocker arms of each intake valve and the rocker arms of the pair of exhaust valves to be operatively connected individually to the pair of exhaust valves are arranged at both sides of the three rocker arms of the side of the intake valves, an ignition plug must be disposed between the rocker arms on the side of both the exhaust valves. However, if the ignition plug is disposed at the exhaust side, it is difficult to improve thermal extraction of the ignition plug. As a result, in order to prevent the occurrence of knocking, the ignition timing cannot be set near an ignition timing for generating a maximum torque, and there arises a problem in which a sufficient torque is not obtained. Further, when the above-described structure is applied to a vehicle-mounted V-type internal combustion engine in which an intake side is disposed inwardly, there also arises a problem in which the space for attaching and detaching the spark plug is inadequate around the internal combustion engine.

SUMMARY OF THE INVENTION

It is therefore an object of the present invention to provide an SOHC-type valve operating system in an internal combustion engine which can reduce frictional loss and provide space for disposing a component such as an ignition plug at an intake valve side.

In order to achieve the above object, there is provided, according to the present invention, an SOHC-type valve operating system for a row of cylinders in an internal combustion engine having a single cam shaft commonly provided for a pair of intake valves and a pair of exhaust valves for each cylinder, a plurality of intake valve driving members rockably disposed between the cam shaft and the pair of intake valves and having an operative-connection switchover mechanism for switching over the connection and disconnection, and a pair of exhaust valve driving members rockably disposed between the cam shaft and the pair of exhaust valves and independently corresponding to each of the exhaust valves, wherein the operative-connection switchover mechanism comprises a switchover pin movable between a position for operatively connecting adjacent intake valve driving members and a position for releasing such connection, and a cylindrical sleeve secured to the intake valve driving members for guiding the movement of the switchover pin, and wherein the cylindrical sleeve rotatably supports a cylindrical rotor in rolling contact with a cam provided at the cam shaft, and the operative-connection switchover mechanism is disposed at an opposite side of the intake valves with respect to a rocking axis of the intake valve driving member. Thus, a space for disposing a component such as an ignition plug can be obtained at an intake side.

According to another feature of the invention, a plug pipe in which an ignition plug is to be inserted is continuously provided in a cylinder head between both said intake valves. Therefore, the ignition plug is arranged at the intake valve side to improve thermal extraction and to improve engine power.

The above and other objects, features and advantages of the invention will become apparent from the following description of preferred embodiments taken in conjunction with the accompanying drawings.

BRIEF DESCRIPTION OF THE DRAWINGS

FIGS. 1 to 7 illustrate one embodiment of the present invention, wherein FIG. 1 is an end view of a V-type internal combustion engine;

FIG. 2 is an enlarged sectional view taken along line 2—2 in FIG. 1;

FIG. 3 is a sectional view taken along line 3—3 in FIG. 2;

FIG. 4 is a sectional view taken along line 4—4 in FIG. 2;

FIG. 5 is a sectional view taken along line 5—5 in FIG. 3;

FIG. 6 is a sectional view taken along line 6—6 in FIG. 5;

FIG. 7 is an explanatory view for illustrating the relationship between the operating timing of an intake valve and the operating timing of an operative-connection switchover mechanism;

FIGS. 9 and 10 illustrate a first modified embodiment of a sleeve fixing structure, wherein FIG. 9 is a sectional view similar to FIG. 8, and FIG. 10 is a sectional view taken along line 10—10 in FIG. 9;

FIGS. 12 and 13 illustrate a third modified embodiment of the sleeve fixing structure, wherein FIG. 12 is a sectional view, similar to FIG. 8; and FIG. 13 is a sectional view taken along line 13—13 in FIG. 12;

FIGS. 24, 25 and 26 illustrate a twelfth modified embodiment of the sleeve fixing structure, wherein FIG. 24 is a sectional view similar to FIG. 21;

FIG. 25 is a perspective view of a sleeve fixed to a rocker arm of the side of the third intake valve;

FIG. 26 is a perspective view of the sleeve fixed to the rocker arm of the side of the second intake valve;

FIGS. 27, 28 and 29 illustrate a thirteenth modified embodiment of the sleeve fixing structure, wherein FIG. 27 is a sectional view similar to FIG. 21;

FIG. 28 is a view taken along line 28—28 in FIG. 27; and

FIG. 29 is a front view of a locking member.

DESCRIPTION OF THE PREFERRED EMBODIMENTS

First, referring to FIGS. 1 to 7, a first embodiment of the present invention will now be described.

Figure 1:
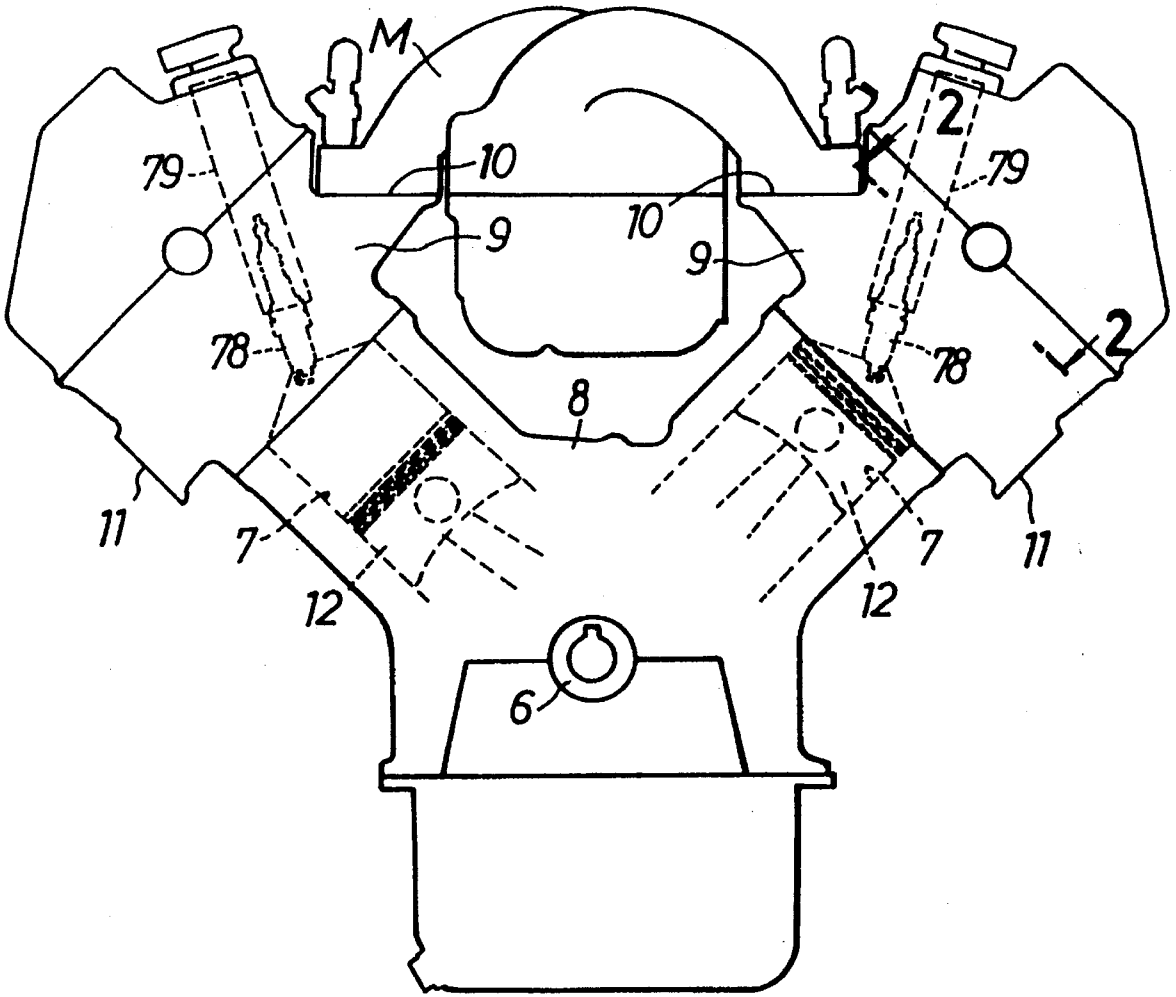

FIG. 1 is an end view of a V-type internal combustion engine. In this engine, one or a plurality of cylinders 7 arranged in an axial direction of a crankshaft 6, and a second one or a plurality of cylinders 7 arranged in the axial direction of the crankshaft 6 and disposed substantially in a V-shape opened upwardly with respect to the former cylinders 7 are provided in a cylinder block 8. Intake ports 10 of the respective cylinders 7 are provided inside the V-shape and exhaust ports 11 of the respective cylinders 7 are provided outside the V-shape in cylinder heads 9 and 9 connected to the cylinder block 8. And an intake manifold M connected to the respective intake ports 10 is disposed between the cylinder heads 9 and 9.

Figure 2:
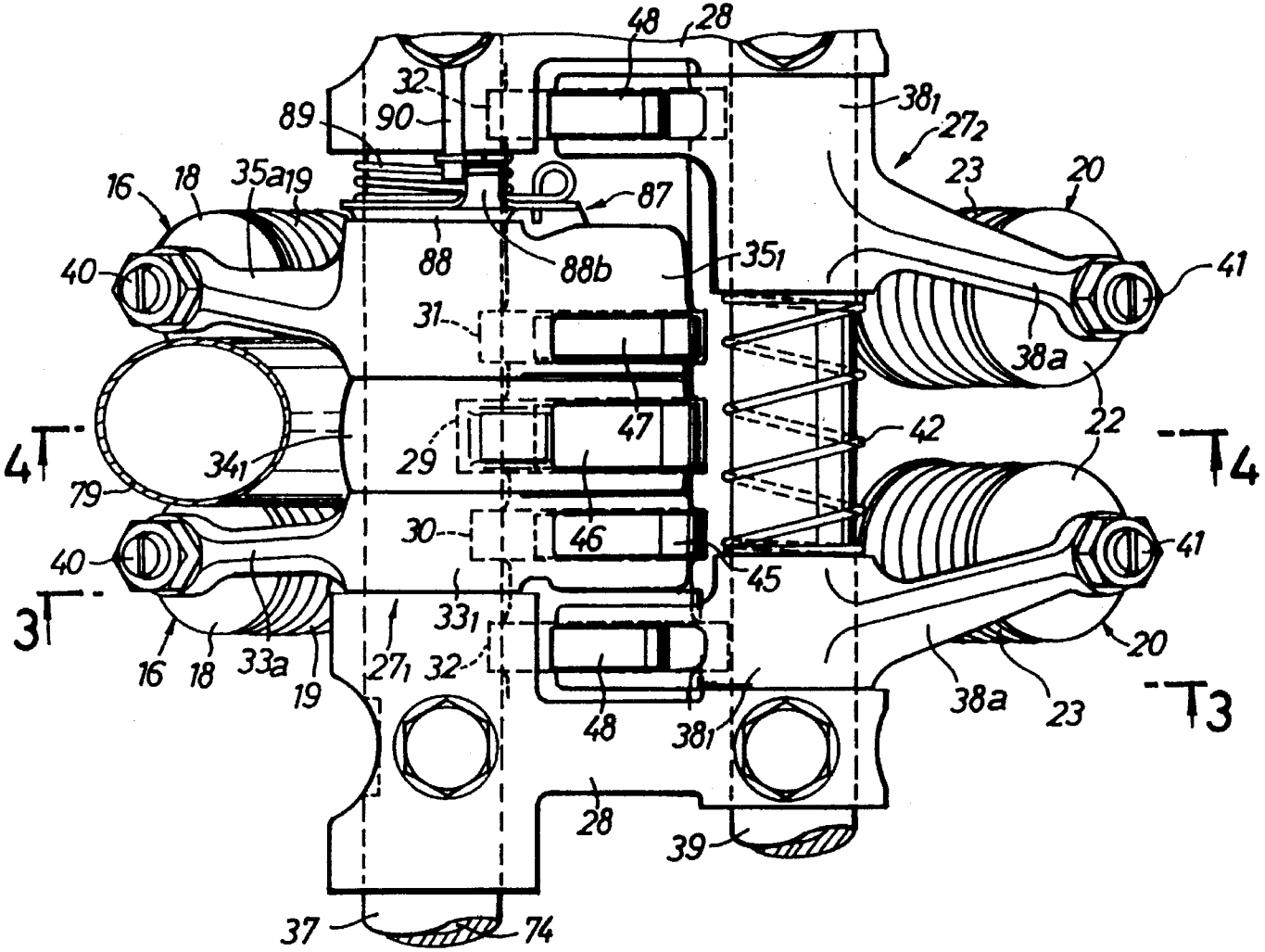
Figure 3:
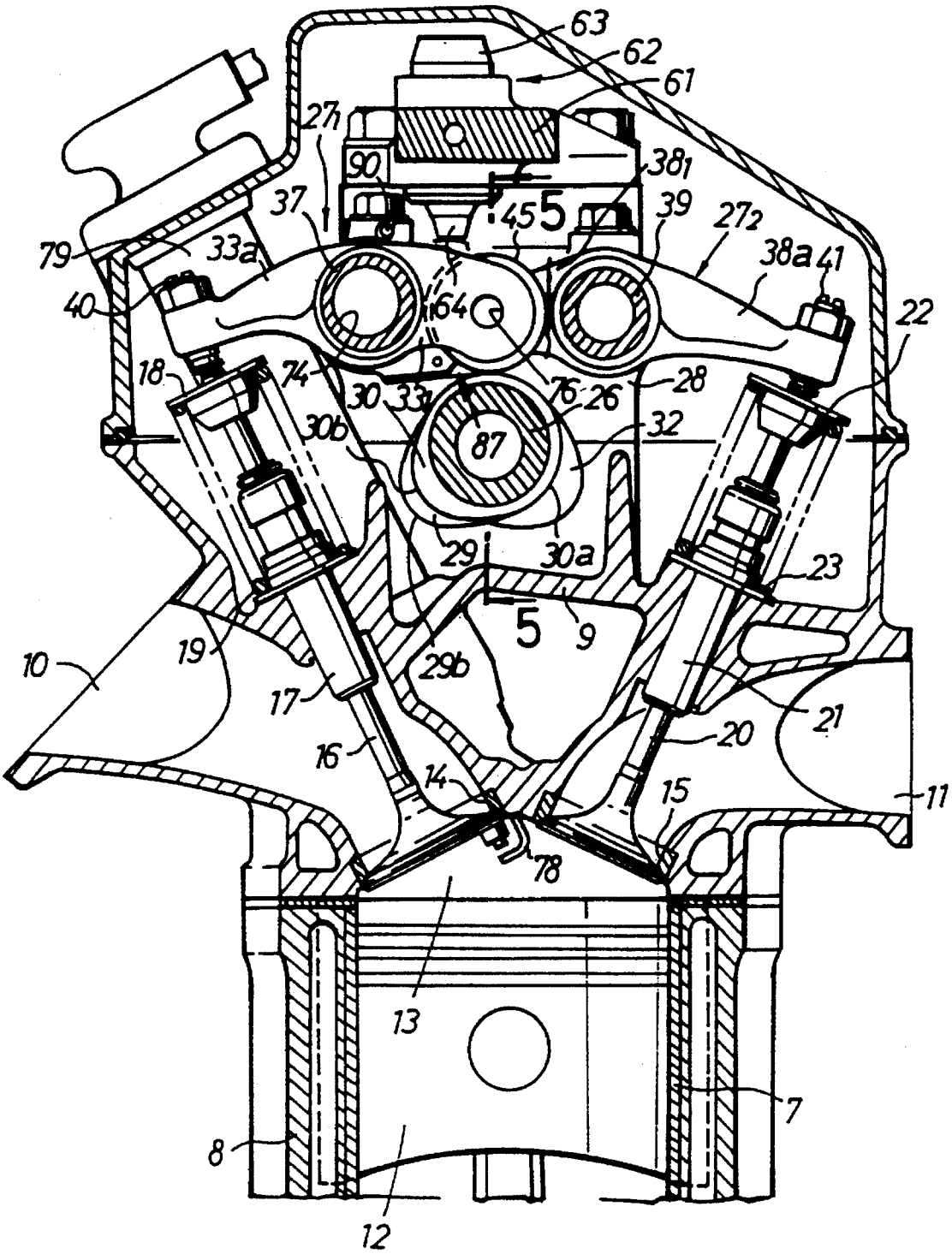
Figure 4:
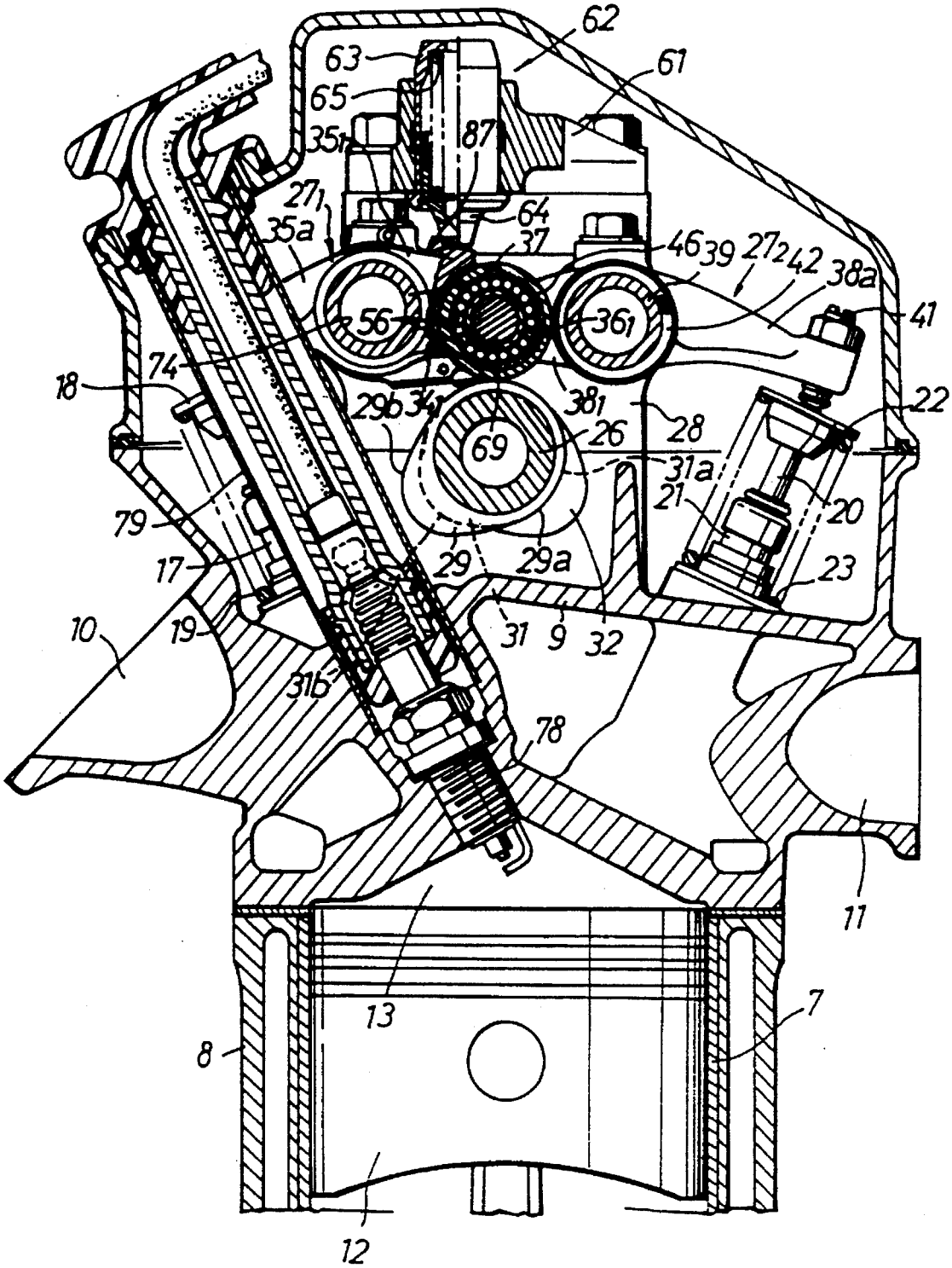

Referring also to FIGS. 2 to 4, pistons 12 are slidably fitted into the respective cylinders 7. Combustion chambers 13 are defined between upper surfaces of the respective pistons 12 and the cylinder heads 9. A pair of intake valve openings 14 and a pair of exhaust valve openings 15 are provided in the cylinder head 9 so as to open the ceilings of the respective combustion chambers 13. Both the intake valve openings 14 respectively communicate with the intake ports 10, and both the exhaust valve openings 15 respectively communicate with the exhaust ports 11.

A pair of intake valves 16 can open and close both the respective intake valve openings 14 separately, and are slidably fitted in guide cylinders 17 provided in the cylinder head 9. Valve springs 19 and 19 are compressed between the cylinder head 9 and retainers 18, 18 provided at the upper ends of the intake valves 16 and 16 protruding upwards from the respective guide cylinders 17 for surrounding the respective intake valves 16 and 16. Therefore, the intake valves 16 and 16 are urged in a direction for closing the intake valve openings 14. A pair of exhaust valves 20 and 20 for opening and closing both the respective exhaust valve openings 15 separately are slidably fitted in guide cylinders 21 provided in the cylinder head 9. Valve springs 23 and 23 are compressed between the cylinder head 9 and retainers 22,22 provided at the upper ends of the exhaust valves 20 and 20 protruding upwards from the respective guide cylinders 21 for surrounding the respective exhaust valves 20 and 20 in a direction for closing the exhaust valve openings 15.

Intake valve driving means $\mathbf{27}_1$ for converting a rotating motion of a cam shaft 26 into opening and closing motions of the intake valves 16, 16 is provided between these valves and the cam shaft 26. The cam shaft 26 is operatively connected to the crankshaft 6 at a reduction ratio of ½. Exhaust valve driving means $\mathbf{27}_2$ for converting a rotating motion of the cam shaft 26 to opening and closing motions of the exhaust valves 20 and 20 is provided between both the exhaust valves 20, 20 and the cam shaft 26.

Figure 5:
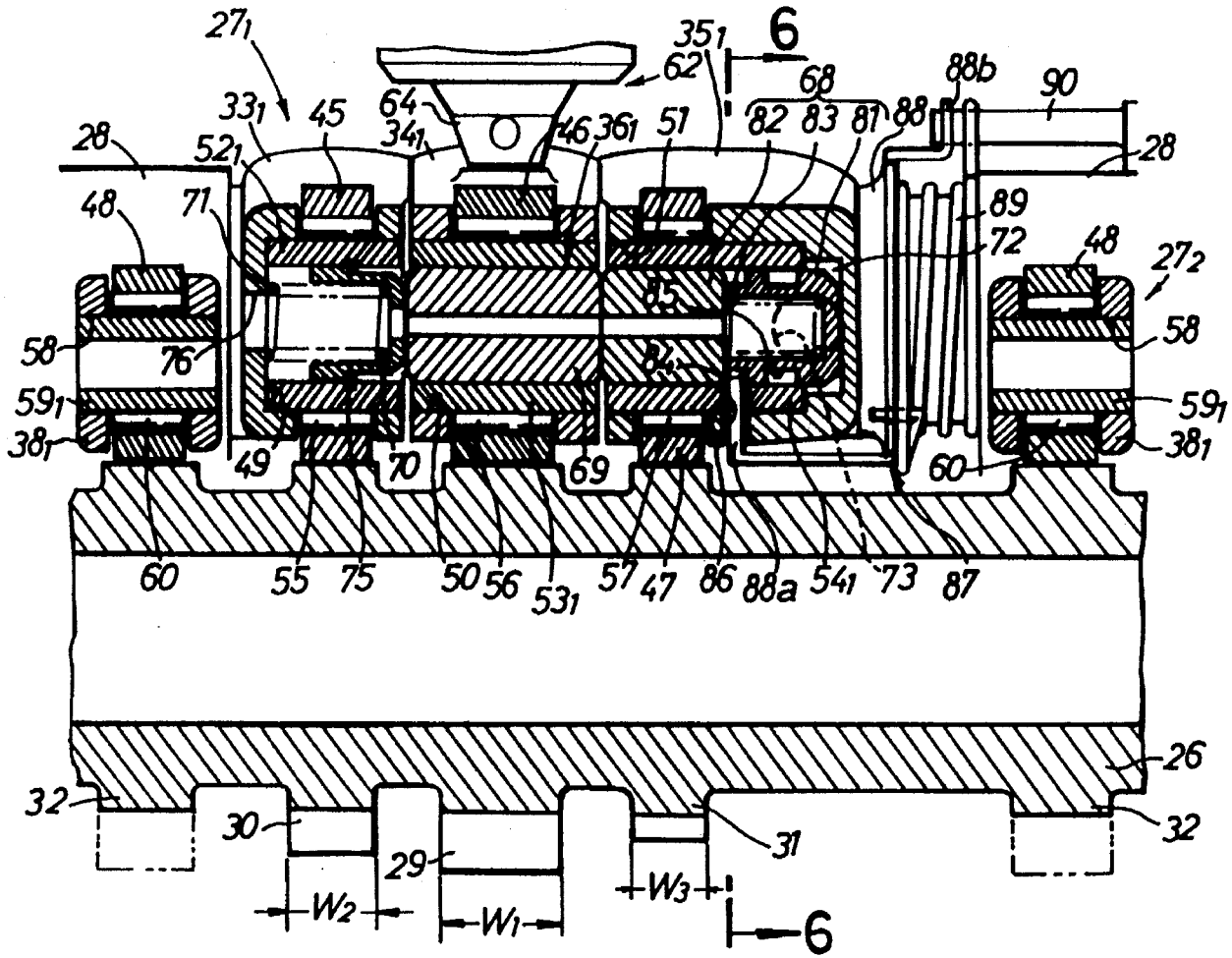

Referring also to FIG. 5, the cam shaft 26 is rotatably supported by the cylinder head 9 and by a holder 28 connected to the cylinder head 9 on an axis parallel to the rotating axis of the crankshaft 6. Fixedly secured to or integrally formed on the cam shaft 26 are: a high speed cam 29 for the intake valves, an intermediate speed cam 30 for the intake valve disposed at one side of the high speed cam 29 so as to correspond to one of the intake valves 16, a low speed cam 31 on the opposite side to the intermediate speed cam 30 with respect to the high speed cam 29, and cams 32 and 32 for the exhaust valves 20 and 20 separately corresponding there to at opposite sides of the intermediate speed cam 30 and the low speed cam 31.

The high speed cam 29 for the intake valve has a shape suitable for opening and closing both the intake valves 16 and 16 in a high speed operating region of the internal combustion engine. The cam 29 includes an arc-shaped base circle portion 29*a* around the axis of the cam shaft 26, and a lobe 29*b* extended radially outward from the base circle portion 29*a*. The intermediate speed cam 30 for the intake valves 16 has a shape suitable for opening and closing one of the intake valves 16 in a low speed operating region of the internal combustion engine. The cam 30 includes an arc-shaped base circle portion 30*a* around the cam shaft 26, and a lobe 30*b* extended from the base circle portion 30*a*. The lobe 30*b* is extended from the base circle portion 30*a* a less amount and at a narrower angle than the lobe 29*b*. The low speed cam 31 for the intake valve 16 has a shape suitable for opening and closing the other intake valve 16 in a low speed operating region of the engine. The cam 31 includes an arc-shaped base circle portion 31*a* around the axis of the cam shaft 26, and a lobe 31*b* extended from the base circle portion 31*a*. The lobe 31*b* is extended from the base circle portion 30*a* a less amount and at a narrower angle than the lobe 30*b*. Further, the width $W_2$ of the intermediate speed cam 30 for the intake valve is shorter along the axial direction thereof than the width $W_1$ of the high speed cam 29 for the intake valves. The width $W_3$ of the low speed cam 31 for the intake valve along is shorter along the axial direction thereof than the width $W_2$ of the intermediate speed cam 30. Further, cams 32 and 32 for the exhaust valves have a shape suitable for opening and closing both the exhaust valves 20 in the same manner irrespective of the operating state of the engine.

The intake valve driving means $\mathbf{27}_1$ includes first, second and third intake valve side rocker arms $\mathbf{33}_1$, $\mathbf{34}_1$, $\mathbf{35}_1$ as intake valve driving members disposed adjacent to each other; and an operative-connection switchover mechanism $\mathbf{36}_1$ for switching over the connection and disconnection of the rocker arms $\mathbf{33}_1$ to $\mathbf{35}_1$. The first intake valve side rocker arm $\mathbf{33}_1$ is operatively connected to the one intake valve 16, the third intake valve side rocker arm $35_1$ is operatively connected to the other intake valve 16, and the second intake valve side rocker arm $34_1$ is disposed between the first and third intake valve side rocker arms $33_1$ and $35_1$. The first to third intake valve side rocker arms $33_1$ to $35_1$ are rockably supported by an intake valve side rocker arm shaft 37 which is secured to the holder 28 at an obliquely upper position relative to the cam shaft 26. The exhaust valve driving means $27_2$ includes a pair of exhaust valve side rocker arms $38_1$ and $38_1$ as exhaust valve driving members to be operatively connected independently to the respective exhaust valves 20 and 20. The exhaust valve side rocker arms $38_1$ are rockably supported by an exhaust valve side rocker arm shaft 39 secured to the holder 28 at an obliquely upper position relative to the cam shaft 26. The first to third intake valve side rocker arms $33_1$ to $35_1$ are adjacently disposed between the holders 28 that disposed on opposite sides of the cylinders 7 along the axis of the crankshaft 6. Both the exhaust valve side rocker arms $38_1$ are disposed between the holders 28 and biased away from each other by a coil spring 42 surrounding the exhaust valve side rocker arm shaft 39.

In the intake valve driving means $27_1$, arms 33*a* and 35*a* extended toward the intake valves 16 are integrally provided with the first and third intake valve side rocker arms $33_1$ and $35_1$. Tappet screws 40 to be abutted against the upper ends of both the intake valves 16 are threadedly fitted into the tip ends of the arms 33*a* and 35*a* for advancing and retreating movements. In the exhaust valve driving means $27_2$, arms 38*a* extended toward the exhaust valves 20 are integrally provided with the exhaust valve side rocker arms $38_1$, and tappet screws 41 to be abutted against the upper ends of both the exhaust valves 20 are threadedly fitted into the tip ends of the arms 38*a* for advancing and retreating movements.

In the first intake valve side rocker arm $33_1$, a cylindrical rotor 45 in rolling contact with the intermediate speed cam 30 for the intake valve is rotatably supported on the opposite side end to the intake valve 16 with respect to the rocking axis of the rocker arm $33_1$, i.e., the axis of the intake valve side rocker arm shaft 37. In the second intake valve side rocker arms $34_1$, a cylindrical rotor 46 in rolling contact with the high speed cam 29 for the intake valves is rotatably supported on the opposite side end to the intake valves 16 with respect to the rocking axis of the rocker arm $34_1$. In the third intake valve side rocker arm $35_1$, a cylindrical rotor 47 in rolling contact with the low speed cam 31 for the intake valve is rotatably supported on the opposite side end to the intake valve 16 with respect to the rocking axis of the rocker arm $35_1$. In the exhaust valve side rocker arms $38_1$, cylindrical rotors 48 in rolling contact with the cams 32 for the exhaust valves 20 are rotatably supported on the opposite ends to the exhaust valves 20 and 30 with respect to the rocking axis of the rocker arm $38_1$, i.e., the axis of the exhaust valve side rocker arm shaft 39.

In the first intake valve side rocker arm $33_1$, a bottomed fitting hole 49 opened toward the second intake valve side rocker arm $34_1$ is provided in parallel with the intake valve side rocker arm shaft 37. The second intake valve side rocker arm $34_1$ is provided with a fitting hole 50 opened to both side surfaces of the rocker arm $34_1$ so as to correspond to the fitting hole 49. The third intake valve side rocker arm $35_1$ is provided with a bottomed fitting hole 51 opened toward the second intake valve side rocker arm $34_1$ in parallel with the intake valve side rocker arm shaft 37 so as to correspond to the fitting hole 50. Cylindrical sleeves $52_1$, $53_1$, $54_1$ of the same diameters are fitted and fixed in the fitting holes 49, 50 and 51, for example, by press-fitting. A plurality of rollers 55, 56, 57 are respectively interposed between the sleeves $52_1$ to $54_1$ and the rotors 45 to 47 which coaxially surround these sleeves. The exhaust valve side rocker arms $38_1$ are provided with fitting holes 58 opened at both the side faces in parallel with the exhaust valve side rocker arm shaft 39. A plurality of rollers 60 are respectively interposed between the cylindrical sleeves $59_1$ fitted and fixed in the fitting holes 58, for example, by press-fitting and the rotors 48 for coaxially surrounding the sleeves $59_1$. Therefore, the first to third intake valve side rocker arm $33_1$ to $35_1$ are respectively driven by the corresponding cams 30, 29 and 31 through the rotors 45 to 47. In addition, since the relationship of (the width $W_1$ of the high speed cam 29) > (the width $W_2$ of the intermediate cam 30) > (the width $W_3$ of the low speed cam 31) is established, the axis lengths of the rotors 46, 45 and 47 are so set as to satisfy the relationship of (the axial length of the rotor 46) > (the axial length of the rotor 45) > (the axial length of the rotor 47). Further, the exhaust valve side rocker arms $38_1$ are respectively driven by the cams 32 for the exhaust valves 20 through the rotors 48.

A supporting plate 61 is secured onto the holders 28 above the intake valve side rocker arms $33_1$ to $35_1$ and the exhaust valve side rocker arms $38_1$. On the supporting plate 61, a lost motion mechanism 62 for resiliently urging the second intake valve side rocker arm $34_1$ in a direction so that the rotor 46 is contacted with the high speed cam 29 for the intake valves. The lost motion mechanism 62 includes a guide member 63 which is secured to the supporting plate 61 and formed into a bottomed cylindrical shape opened downwards, a lifter 64 which is slidably fitted to the guide member 63 and abutted at its tip end against the second intake valve side rocker arm $34_1$, and a lifter spring 65 compressed between the lifter 64 and the guide member 63.

The operative-connection switchover mechanism $36_1$ includes a first switchover pin 68 for switching over the connection and disconnection of the third and second intake valve side rocker arms $35_1$ and $34_1$, a second switchover pin 69 capable of switching over the connection and disconnection of the second and first intake valve side rocker arms $34_1$ and $33_1$, a restrain member 70 slidably contacted with the second switchover pin 69 at the opposite side from the first switchover pin 68, and a return spring 71 for urging the restrain member 70 toward the second switchover pin 69.

The first switchover pin 68 includes a spring compressed between a bottomed cylindrical urging member 81 and a short columnar locking member 82. The pin 68 is slidably fitted in the sleeve $54_1$ of the third intake valve side rocker arm $35_1$. Further, a fluid pressure chamber 72 is defined between the closed end of the fitting hole 51 of the third intake valve side rocker arm $35_1$ and the urging member 81 of the first switchover pin 68. A communication passage 73 communicating with the fluid pressure chamber 72 is provided in the third intake valve side rocker arm $35_1$. A fluid pressure passage 74 always communicating with the communication passage 73 is provided in the intake valve side rocker arm shaft 37. The fluid pressure passage 74 is connected to a fluid pressure source through a control valve (not shown).

The second switchover pin 69 is slidably fitted in the sleeve $53_1$ of the second intake valve side rocker arm $34_1$. One end of the second switchover pin 69 is slidably contacted with an end face of the locking member 82 of the first switchover pin 68.

The restrain member 70 is slidably fitted in the sleeve $52_1$ of the first intake valve side rocker arm $33_1$. A closed end of the restrain member 70 is slidably contacted with the other end of the second switching pin 69. A snap ring 75 for abutting against the restraining member 70 and preventing the latter from dropping out of the sleeve $52_1$ is attached to the inner surface of the sleeve $52_1$. The return spring 71 is compressed between the restraining member 70 and the closed end of the fitting hole 49 of the first intake valve side rocker arm $33_1$. An opening hole 76 is provided in the closed end of the fitting hole 49.

In the first switchover pin 68, an engaging step portion 84 is provided on an outer periphery of the edge of the urging member 81 near the locking member 82, and an annular engaging groove 85 is provided on the outer surface of the intermediate portion of the urging member 81. Further, a timing plate 88 of a triggering mechanism 87 can be engaged with the engaging step portion 84 and the engaging groove 85. A groove 86 for slidably engaging the engaging portion 88*a* of the timing plate 88 is provided on the lower portion of the third intake valve side rocker arm $35_1$. The groove 86 is located at a position corresponding the engaging step portion 84 in a state that the urging member 81 is moved to the maximum limit toward the fluid pressure chamber 72. The position of the engaging groove 85 is defined such that it becomes a position corresponding to the groove 86 when a fluid pressure is applied to the fluid pressure chamber 72 so that the urging member 81 is moved to the maximum limit in a direction for pressing the locking member 82 thereby to completely connect the third and second intake valve side rocker arms $35_1$ and $34_1$ through the locking member 82.

Figure 6:
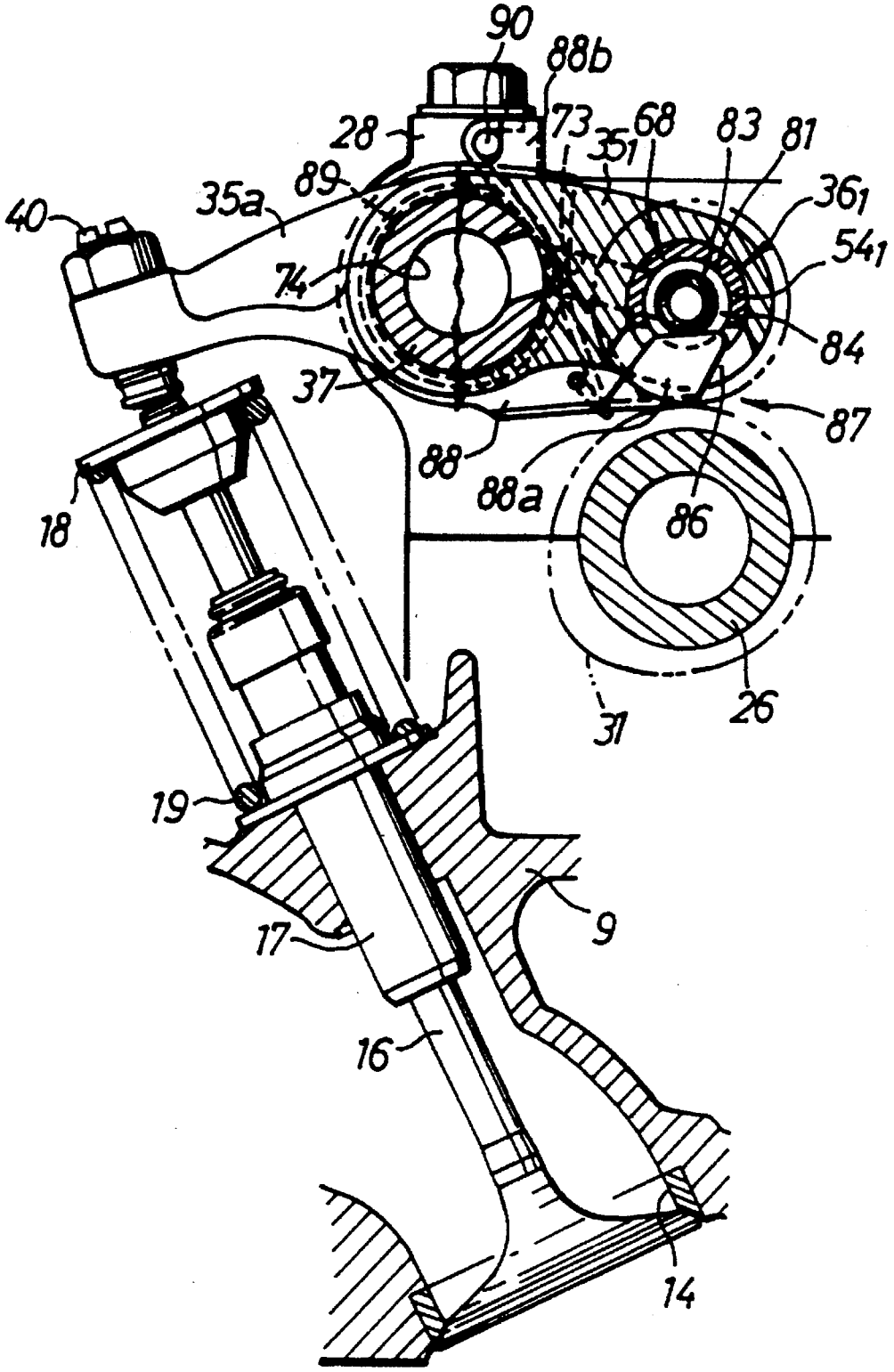

Referring also to FIG. 6, the triggering mechanism 87 includes: a timing plate 88 which has an engaging portion 88*a* to be fitted in the groove 86 and which is supported on the intake valve side rocker arm shaft 37 for rocking with the third intake valve side rocker arm $35_1$; a torsion spring 89 engaged, at its one end, with the timing plate 88 and surrounding the intake valve side rocker arm shaft 37; and a pin 90 capable of engaging with a stopper 88*b* protruding from the timing plate 88 and engaged with the other end of the torsion spring 89. The pin 90 is embedded in the holder 28.

In such a triggering mechanism 87, the engaging portion 88*a* of the timing plate 88 is engaged with the engaging step portion 84 or the engaging groove 85 from the groove 86 in a state where the third intake valve side rocker arm $35_1$ is slidably contacted with the base circle portion 31*a* of the low speed cam 31 for the intake valve and stopped, and is disengaged from the groove 86 when the third intake valve side rocker arm $35_1$ is slidably contacted with the lobe 31*b* of the low speed cam 31 for the intake valve for rockably moving the intake valve 16 in a direction for opening the intake valve 16.

An ignition plug 78 is arranged at the center of the ceiling of the combustion chamber 13. A plug pipe 79 in which the ignition plug 78 is to be inserted is provided in the cylinder head 9. In the intake valve driving means $27_1$, the intake valve side rocker arms $33_1$ to $35_1$ are respectively driven by the cams 30, 29, 31 of the cam shaft 26 through the rotors 45 to 47 at the opposite side from the intake valves 16 with respect to the intake valve side rocker arm shaft 37. Since the operative-connection switchover mechanism $36_1$ is coaxially disposed with the rotors 45 to 47, a vacant space is provided between the arms 33*a* and 35*a* of the first and third intake valve side rocker arms $33_1$ and $35_1$ and thus, the plug pipe 79 can be mounted in the vacant space. Therefore, in a V-type internal combustion engine for a vehicle in which the intake side is disposed inside the V, the plug pipe 79 for attaching and detaching the ignition plug 78 can be arranged inside the V of the V-type internal combustion engine.

The operation of the first embodiment described above will now be described. In the low speed operating region of the internal combustion engine, the fluid pressure is not applied to the fluid pressure chamber 72 of the operative-connection switchover mechanism $36_1$. The slidably contacting surfaces of the first and second switchover pins 68 and 69 are located at corresponding positions between the third and second intake valve side rocker arms $34_1$ and $35_1$. The slidably contacting surfaces of the second switchover pin 69 and the restrain member 70 are located at corresponding positions between the second and first intake valve side rocker arms $34_1$ and $33_1$. Therefore, the intake valve side rocker arms $33_1$ to $35_1$ are capable of rocking relative to each other. Thus, one of the intake valves 16 is driven for opening and closing at the timing and the lift amount in accordance with the intermediate speed cam 30 for that intake valve, while the other intake valve 16 is driven for opening and closing at the timing and the lift amount in accordance with the low speed cam 31 for that intake valve.

In this state, the first switchover pin 68 is in a state where it is displaced to the maximum limit toward the fluid pressure chamber 72. The engaging portion 88*a* of the timing plate 88 of the triggering mechanism 87 is engaged with the engaging step portion 84 when the third intake valve side rocker arm $35_1$ is in a stopped state, and is disengaged from the engaging step portion 84 in response to the rocking operation of the third intake valve side rocker arm 35, in a direction for opening the intake valve 16.

Figure 7:
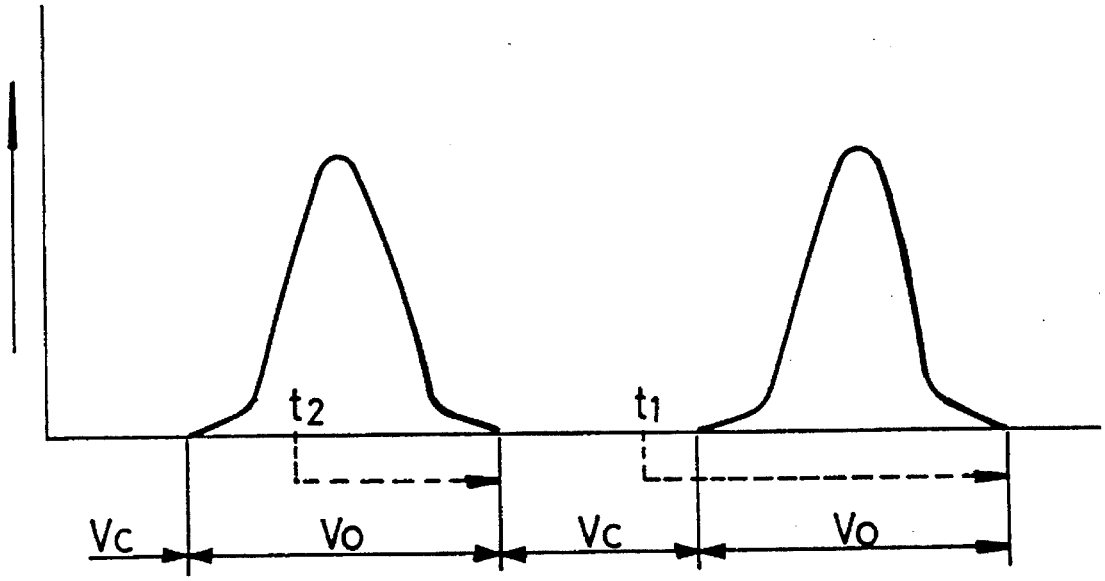

As shown in FIG. 7, in the high speed operating region of the internal combustion engine, when the fluid pressure is applied to the fluid pressure chamber 72 at a timing $t_1$ of a valve closing zone Vc of the intake valves 16, the urging member 81 of the first switchover pin 68 tries to start moving. But since the engaging portion 88*a* of the timing plate 88 is engaged with the engaging step portion 84, the movement of the urging member 81 is prevented, and the first switchover pin 68 is kept in a state as shown in FIG. 5.

Then, when the engine enters a valve opening zone Vo of the intake valves 16 and the third intake valve side rocker arm $35_1$ starts rocking, the third intake valve side rocker arm $35_1$ leaves the timing plate 88 and the engaging portion 88*a* of the timing plate 88 is disengaged from the engaging step portion 84. In this manner, the urging member 81 tries to start moving, but engagement of the locking member 82 with the sleeve $53_1$ is prevented by the displacement of the axis of the sleeve $54_1$ of the third intake valve side rocker arm $35_1$ from the axis of the sleeve $53_1$ of the second intake valve side rocker arm due to the rocking of the third intake valve side rocker arm $35_1$. When next valve closing zone Vc is started, the axes of the sleeves $53_1$ and $54_1$ are brought substantially into coincidence so that the urging member 81 urges the locking member 82 which starts moving. Thus, the locking member 82 is fitted into the sleeve $53_1$, the second switchover pin 59 is fitted into the sleeve $52_1$, and the first to third intake valve side rocker arms $33_1$ to $35_1$ are integrally connected. In this manner, both the intake valves 16 are driven to be opened and closed at the timing and the lift amount in accordance with the high speed cam 29 of the intake valves.

When the operative-connection switchover mechanism $36_1$ is in an operatively connecting state, the engaging groove 85 is located at a position corresponding to the groove 86, and the engaging portion 88*a* of the timing plate 88 is engaged with the engaging groove 85 in the valve closing zone Vc.

Then, when the fluid pressure is released from the fluid pressure chamber 72 at the timing $t_1$ of the valve closing zone Vc, of the first switchover pin 68 is pressed by the return spring 71 toward the fluid pressure chamber 72. But since the engaging portion 88*a* is engaged with the engaging groove 85, the movement of the first switchover pin 68 is prevented. When the engine enters the valve opening zone Vo, the engaging portion 88*a* of the timing plate 88 is disengaged from the engaging groove 85 in response to the rocking operation of the third intake valve side rocker arm $\mathbf{35}_1$, and the urging member 81 is moved by a force of the spring 83 toward the fluid pressure chamber 72. In this case, the locking member 82 is not returned toward the sleeve $\mathbf{54}_1$ because of the frictional force with the inner surfaces of the sleeves $\mathbf{53}_1$ and $\mathbf{54}_1$, but is moved toward the sleeve $\mathbf{54}_1$ and returned to the state shown in FIG. 5 when the engine enters the next valve closing zone Vc.

When the fluid pressure is applied to the fluid pressure chamber 72 at the timing $t_2$ of the valve opening zone Vo during transfer from the low speed operating region to the high speed operating region, the engaging portion 88*a* of the timing plate 88 is disengaged from the engaging step portion 84, but the engagement of the locking member 82 with the sleeve $\mathbf{53}_1$ is prevented because the axis of the sleeve $\mathbf{54}_1$ of the third intake valve side rocker arm $\mathbf{35}_1$ and the axis of the sleeve $\mathbf{53}_1$ of the second intake valve side rocker arm $\mathbf{34}_1$ are offset from each other. When next valve closing zone Vc is started, the axis of the sleeves $\mathbf{53}_1$ and $\mathbf{54}_1$ are brought substantially into coincidence so that the urging member 81 thereby causes the locking member 82 to start moving. Thus, the locking member 82 is engaged with the sleeve $\mathbf{53}_1$ the second switchover pin 69 is engaged with the sleeve $\mathbf{52}_1$, and the first to third intake valve side rocker arms $\mathbf{33}_1$ to $\mathbf{35}_1$ are integrally connected.

In this manner, it is possible to improve the output of the internal combustion engine by the valve operating characteristics being adapted for the operating state of the engine, by varying the opening and closing characteristics of both the intake valves 16 in the low and high speed operating regions of the engine.

On the other hand, both the exhaust valves 20 are driven for opening and closing at the same timing and the lift amount in accordance with the cams 32 and 32 for the exhaust valves in both the low and high speed operating regions of the engine.

In such a valve operating system, in both the intake valve driving means $\mathbf{27}_1$ and the exhaust valve driving means $\mathbf{27}_2$, the rocker arms $\mathbf{33}_1$ to $\mathbf{35}_1$, $\mathbf{38}_1$, $\mathbf{38}_1$ are respectively driven by the corresponding cams 30, 29, 31, 32, 32 through the rotors 45 to 47, 48, 48. Therefore, the frictional loss is reduced thereby to reduce the required valve opening power. Further, the operative-connection switchover mechanism $\mathbf{36}_1$ provided at the first to third intake valve side rocker arms $\mathbf{33}_1$ to $\mathbf{35}_1$ is coaxially disposed at the rotors 45 to 47. The first switchover pin 68, the second switchover pin 69, the restrain member 70 and the return spring 71 of the operative-connection switchover mechanism $\mathbf{36}_1$ are inserted into the sleeves $\mathbf{52}_1$ to $\mathbf{54}_1$ that are secured to the rocker arms $\mathbf{33}_1$ to $\mathbf{35}_1$ to support to the rotors 45 to 47. Therefore, it is not necessary to provide separate holes for constructing the operative-connection switchover mechanism $\mathbf{36}_1$ at the respective rocker arms $\mathbf{33}_1$ to $\mathbf{35}_1$, which contributes to a reduction of the number of the manufacturing steps.

Further, since the ignition plugs 78 can be disposed at the side of the intake valves 16, thermal extraction around the ignition plug 78 can be improved. Even if the ignition timing of the ignition plug 78 is set in the vicinity of the preferred ignition timing for generating a maximum torque, occurrence of knocking can be suppressed, and accordingly sufficient output torque of the engine can be obtained.

In addition, in the V-type internal combustion engine for the vehicle in which the intake side is disposed inside the V, the ignition plugs 78 are disposed at the side of the intake valves 16. Thus, the space for attaching and detaching the ignition plugs 78 is provided in the upper portion of the V-type internal combustion engine, and it is easy to provide the space for attaching and detaching the ignition plugs 78.

It is considered in the operative-connection switchover mechanism $\mathbf{36}_1$ that, even if a high fluid pressure is applied to the fluid pressure chamber 72 and the operative connection of the first and second switchover pins 68 and 69 is disturbed due to some reason whereby the operative-connection switchover mechanism $\mathbf{36}_1$ remains in a disconnected state the intake valve operation is satisfactory. In this case, the first intake valve side rocker arm $\mathbf{33}_1$ for driving the intake valve 16 which is actuated at relatively high lift of both the intake valves 16 to be operated independently from one another, in order to provide the valve operating behavior up to a predetermined high speed range, normally it is necessary to set the spring load of the valve spring 19 to a relatively high value corresponding to the weight of the first intake valve side rocker arm $\mathbf{33}_1$. Therefore, if the first intake valve side rocker arm $\mathbf{33}_1$ is relatively heavy, the spring load of the valve spring 19 must be correspondingly set to a large value, and the valve opening power required is increased in both the connection and disconnection states. However, since the third intake valve side rocker arm $\mathbf{35}_1$ is provided with the fluid pressure chamber 72 and the communication passage 73 for driving one of the intake valves 16 which has a lower lift amount, the first intake valve side rocker arm $\mathbf{33}_1$ can be reduced in weight because the rocker arm $\mathbf{33}_1$ does not have such chamber 72 and the passage 73. Therefore, the spring load for urging the first intake valve side rocker arm $\mathbf{33}_1$ can be set to a relatively low value to contribute to a reduction in the required valve opening power.

The first switchover pin 68 of the operative-connection switchover mechanism $\mathbf{36}_1$ is formed to be relatively long so as to engage the engaging portion 88*a* of the timing plate 88. The relatively short restrain member 70 and return spring 71 may simply be provided in the first intake valve side rocker arm $\mathbf{33}_1$ by providing the first switchover pin 68 in the third intake valve side rocker arm $\mathbf{35}_1$ for driving the one of the intake valves 16 having a lower lift amount among the two intake valves 16 independently operated from one another in the disconnected state of the operative-connection switchover mechanism $\mathbf{36}_1$, which reduces the weight for setting the spring load thereby to reduce the required valve opening power.

The third intake valve side rocker arm $\mathbf{35}_1$ needs, in addition to a portion necessary to slidably contact with the low speed cam 31 for the intake valve 16, a portion necessary to engage the timing plate 88 with the first switchover pin 68 and a portion necessary to provide the fluid pressure chamber 72 and the communication passage 73. However, since the relationship of (the axial length of the rotor 46) > (the axial length of the rotor 45) > (the axial length of the rotor 47) is satisfied, it is possible to set the width of the third intake valve side rocker arm $\mathbf{35}_1$ along the axis of the intake valve side rocker arm shaft 37 to a relatively small value irrespective of the arrangements of the fluid pressure chamber 72 and the communication passage 73 as well as the arrangement of the first switchover pin 68, Thus, an increase in the weight of the third intake valve side rocker arm $35_1$ is suppressed to contribute to a reduction in the required valve opening power as much as possible and the valve operating system may be constructed relatively simply along the axis of the cam shaft 26.

The intake valve driving means $27_1$ of the first embodiment described above includes the triggering mechanism 87 for determining the operation starting timing of the operative-connection switchover mechanism $36_1$. But the present invention can also be applied to intake valve driving means having no triggering mechanism as will be described in a second embodiment shown in FIG. 8. The present invention is not limited to the embodiment described above. As a second embodiment shown in FIG. 8, the present invention may also be applied to intake valve driving means having no triggering mechanism. The components of this second embodiment and other embodiments that are the same as the first embodiment will be numbered the same and not described in detail again.

Figure 8:
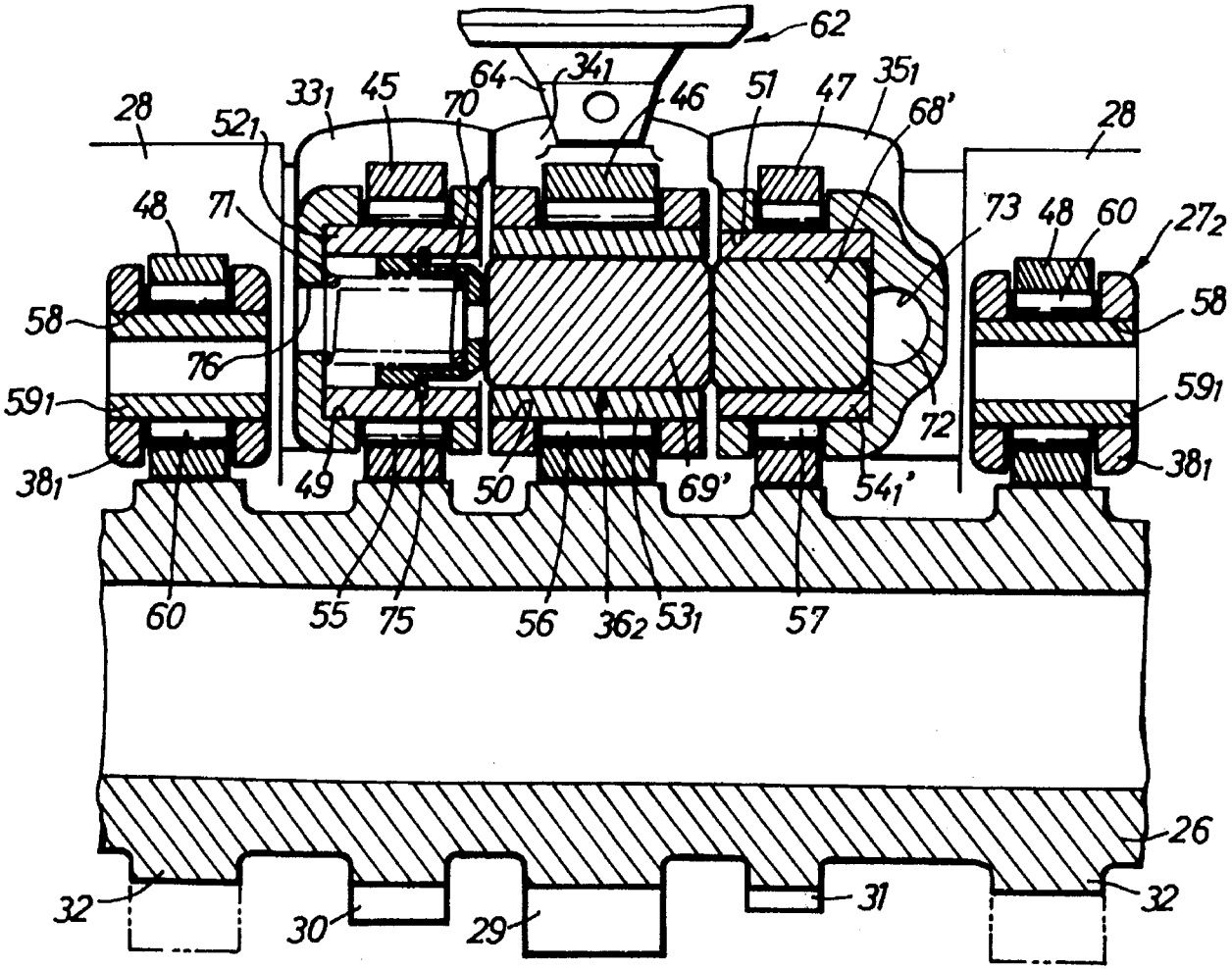
FIG. 8 is a sectional view, similar to FIG. 5, of a second embodiment of the present invention.

In FIG. 8, an operative-connection switchover mechanism $36_2$ includes a first switchover pin 68' for switching over the connection and disconnection of third and second intake valve side rocker arms $35_1$ and $34_1$, a second switchover pin 69' for switching over the connection and disconnection of second and first intake valve side rocker arms $34_1$ and $33_1$, a restrain member 70 slidably contacted with the second switchover pin 69 at the opposite side from the first switchover pin 68', and a return spring 71 for urging the restrain member 70 toward the second switchover pin 69'.

The first switchover pin 68' is formed in a short columnar shape and slidably mounted in a sleeve $54_1$'. A fluid pressure chamber 72 is defined between a closed end of a fitting hole 51 of the third intake valve side rocker arm $35_1$ and the first switchover pin 68'. The second switchover pin 69' is formed in a short columnar shape and slidably mounted in the sleeve $53_1$ of the second intake valve side rocker arm $34_1$.

In order to reliably secure the sleeves to the respective rocker arms $33_1$ to $35_1$, $38_1$, $38_1$, it may be possible to use a weld, a caulk or any other convenient means. However, it is preferable to use a heat treatment on a surface of the sleeve for rotatably supporting the cylindrical rotor for obtaining a hardness near $H_RC$ 60 taking into account the pitching resistance. It is also preferable to use case-hardening steel and heat treating for the respective rocker arms $33_1$ to $35_1$, $38_1$, $38_1$. However, if the heat-treated member is welded, delayed fracture might occur due to residual tensile stress. Further, since a member having high hardness cannot be caulked (meaning squashing or crushing one or both adjoining metal parts to secure them together without heat or any separate joining material), it is difficult to accomplish a fixing structure by welding or caulking in an "as is" condition. In addition, it must be avoided to produce a portion protruding toward adjacent rocker arm side by fixing the sleeves to the respective rocker arms $33_1$ to $35_1$, $38_1$, $38_1$ in order to simplify the valve operating system.

Therefore, a modified embodiment in which a sleeve is reliably fixed to a rocker arm in a simple fixing structure will now be described.

Figure 9:
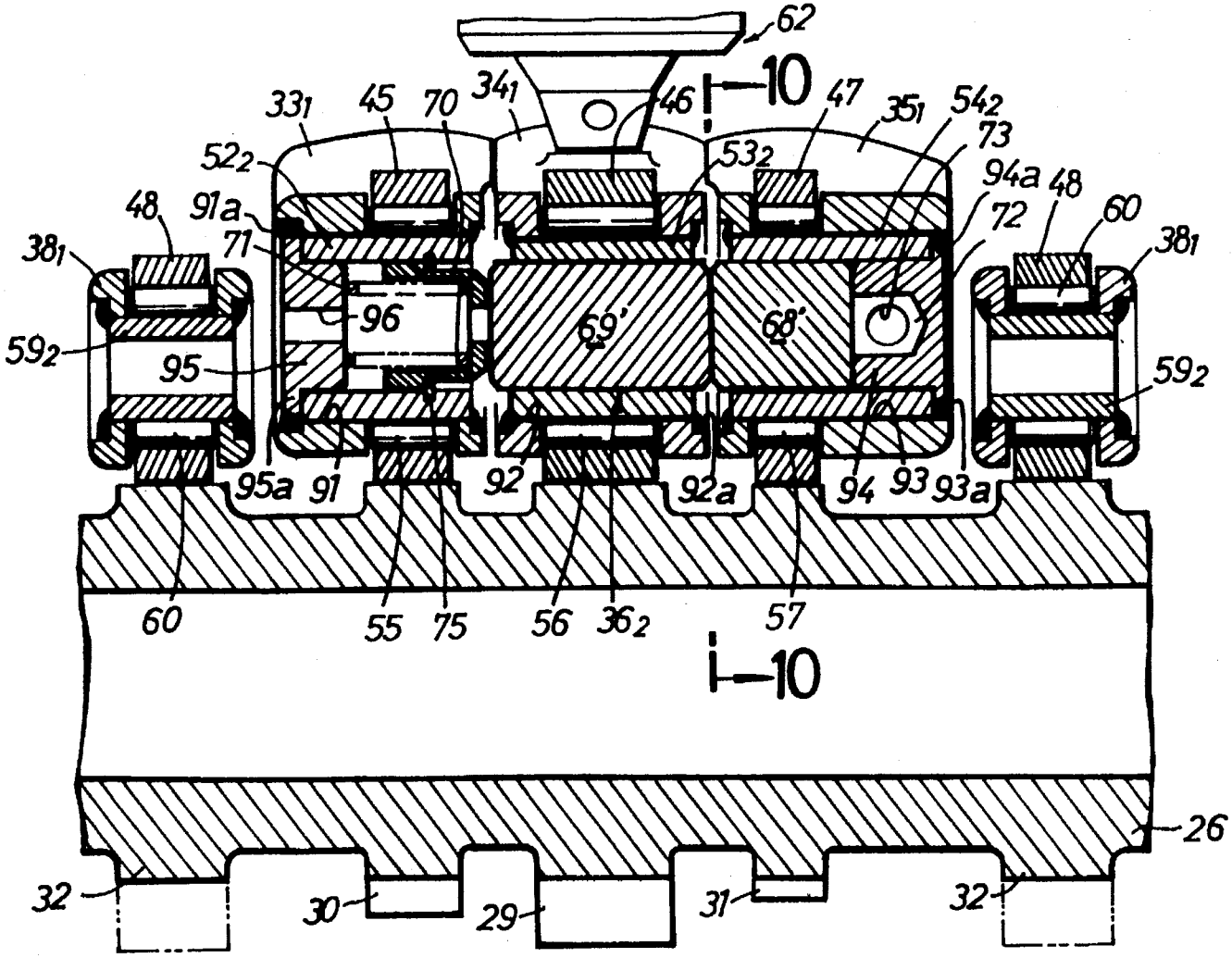
Figure 10:
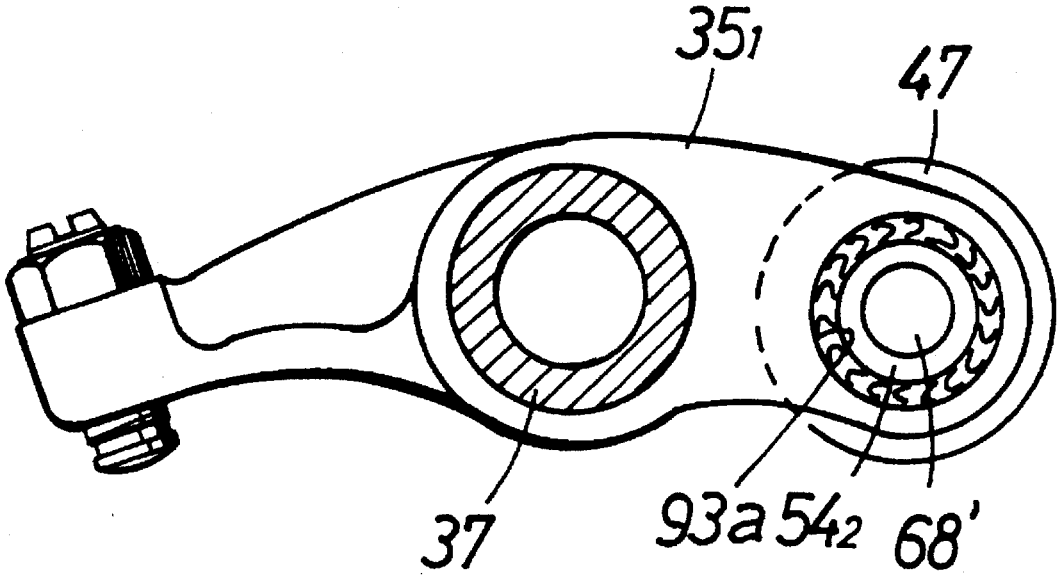

FIGS. 9 and 10 illustrate a first modified example of a sleeve fixing structure, and the similar reference numerals are given to components corresponding to those of the previous embodiment.

Engaging holes 91, 92, 93 are respectively provided in the first, second and third intake valve side rocker arms $33_1$, $34_1$, $35_1$. Sleeves $52_2$, $53_2$, $54_2$ are welded and secured to the respective rocker arms, $33_1$, $34_1$, $35_1$ in a state where the sleeves $52_2$, $53_2$, $54_2$ are respectively engaged in the fitting holes 91, 92, 93.

Connection switching means $36_2$ includes a first switchover pin 68', a second switchover pin 69', a restrain member 70, and a return spring 71. The first switchover pin 68' can be slidably mounted within the sleeve $54_2$ so that the pin 68' is slidably engageable with the sleeve $53_2$. A fluid pressure chamber 72 is defined between one end of the first switchover pin 68' and a bottomed cylindrical lid member 94 for closing one end of the sleeve $54_2$. The second switchover pin 69' can be slidably mounted within the sleeve $53_2$ and slidably engageable with the sleeve $52_2$. The restrain member 70 is slidably mounted within the sleeve $52_2$. The opposite side end of the sleeve $52_2$ to the second intake valve side rocker arm $34_1$ is closed by a lid member 95 coaxially having an opening hole 96. The return spring 71 is compressed between the lid member 95 and the restrain member 70.

The first, second and third intake valve side rocker arms $33_1$, $34_1$, $35_1$ are formed of case-hardening steel whose surface is subjected to a quenching treatment. The fitting holes 91, 92, 93 are respectively provided in the rockers $33_1$, $34_1$, $35_1$ so that case-hardening layers do not remain on inner surfaces at the time of finishing. On the other hand, the sleeves $52_2$, $53_2$, $54_2$ are quenched so that the surface hardness becomes about $H_RC$ 60. If the first, second and third intake valve side rocker arms $33_1$, $34_1$, $35_1$ are welded to the sleeves $52_2$, $53_2$, $54_2$ so as to reliably fix these sleeves to the rocker arms in a state where the quenched portions remain, a delayed fracture might occur due to residual tensile stress. Therefore, the intake valve side rocker arms $33_1$, $34_1$, $35_1$ are subjected to a counter boring treatment so as to form recesses **91*a*, 92*a*, 93*a* to be recessed axially inward on both ends of the fitting holes 91, 92, 93 thereby to remove the quenched portions of both ends of the fitting holes 91, 92, 93. Then, both ends of the sleeves $52_2$, $53_2$, $54_2$ are cut off and removed thereby to remove the quenched portions, and the rocker arms are respectively welded to the sleeves in the recesses 91*a*, 92*a*, 93*a* over the entire peripheral surfaces as shown in FIG. 10**.

In this case, a large-diameter portion **94*a* to be engaged with one end of the sleeve $54_2$ is provided integrally with the lid member 94 for closing the one end of the sleeve $54_2$ and the large-diameter portion 94*a* is welded together with the sleeve $54_2$ to the third intake valve side rocker arm $35_1$. A large-diameter portion 95*a* to be engaged with the end of the sleeve $52_2$ is provided integrally with the lid member 95 for closing the end of the sleeve $52_2$, and the large-diameter portion 95*a*** is welded together with the sleeve $52_2$ to the third intake valve side rocker arm $33_1$.

The sleeves $59_2$, $59_2$ are fixed to the exhaust valve side rocker arms $38_1$, $38_1$ in a structure similar to the welding fixing structure of the second intake valve side rocker arm $34_1$ to the sleeve $53_2$.

According to the first modified embodiment described above, a delayed fracture due to residual tensile stress is prevented, and the sleeves $52_2$, $53_2$, $54_2$, $59_2$, $59_2$ can be reliably fixed to the respective rocker arms $33_1$, $34_1$, $35_1$, $38_1$, $38_1$. The lid members 94 and 95 are welded together with the sleeves $54_2$, $52_2$ to the respective third and first intake valve side rocker arms $35_1$ and $33_1$ thereby to simplify assembling steps and efficiently assemble them. Further since the intake valve side rocker arms $33_1$, $34_1$, $35_1$ are welded to the respective sleeves $52_2$, $53_2$, $54_2$ in the recesses **91*a*, 92*a*, 93*a***, the welded portions do not protrude toward the adjacent rocker arms, but the rocker arms $33_1$ to $35_1$ can be simply disposed.

Figure 11:
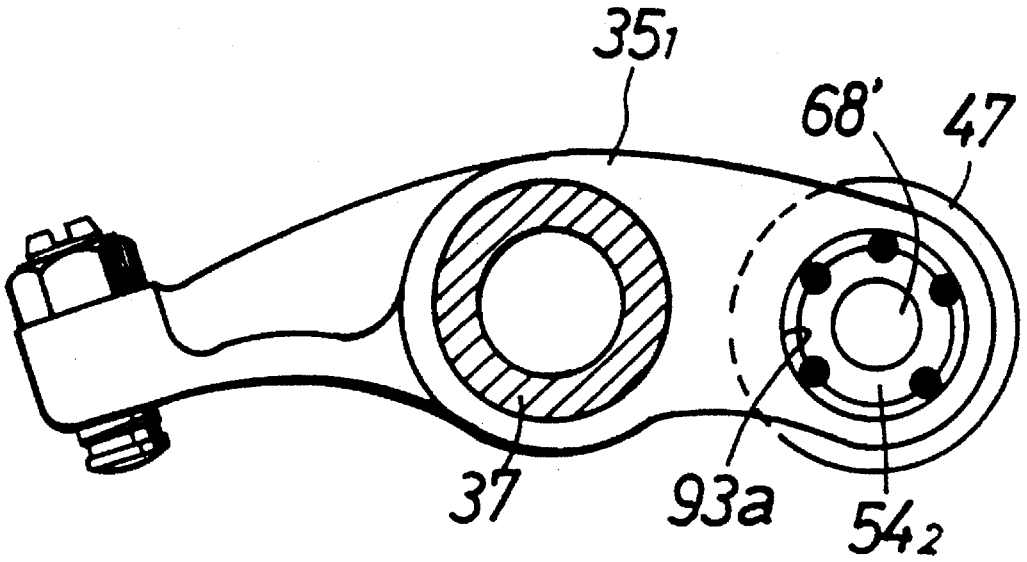
FIG. 11 is a sectional view, similar to FIG. 10, of a second modified embodiment of the sleeve fixing structure.

FIG. 11 illustrates a second modified embodiment of the sleeve fixing structure. Rocker arms $33_1$, $34_1$, $35_1$, $38_1$, $38_1$ may be welded to the respective sleeves $52_2$, $53_2$, $54_2$, $59_2$, $59_2$ at a plurality of positions in a circumferential direction.

Figure 12:
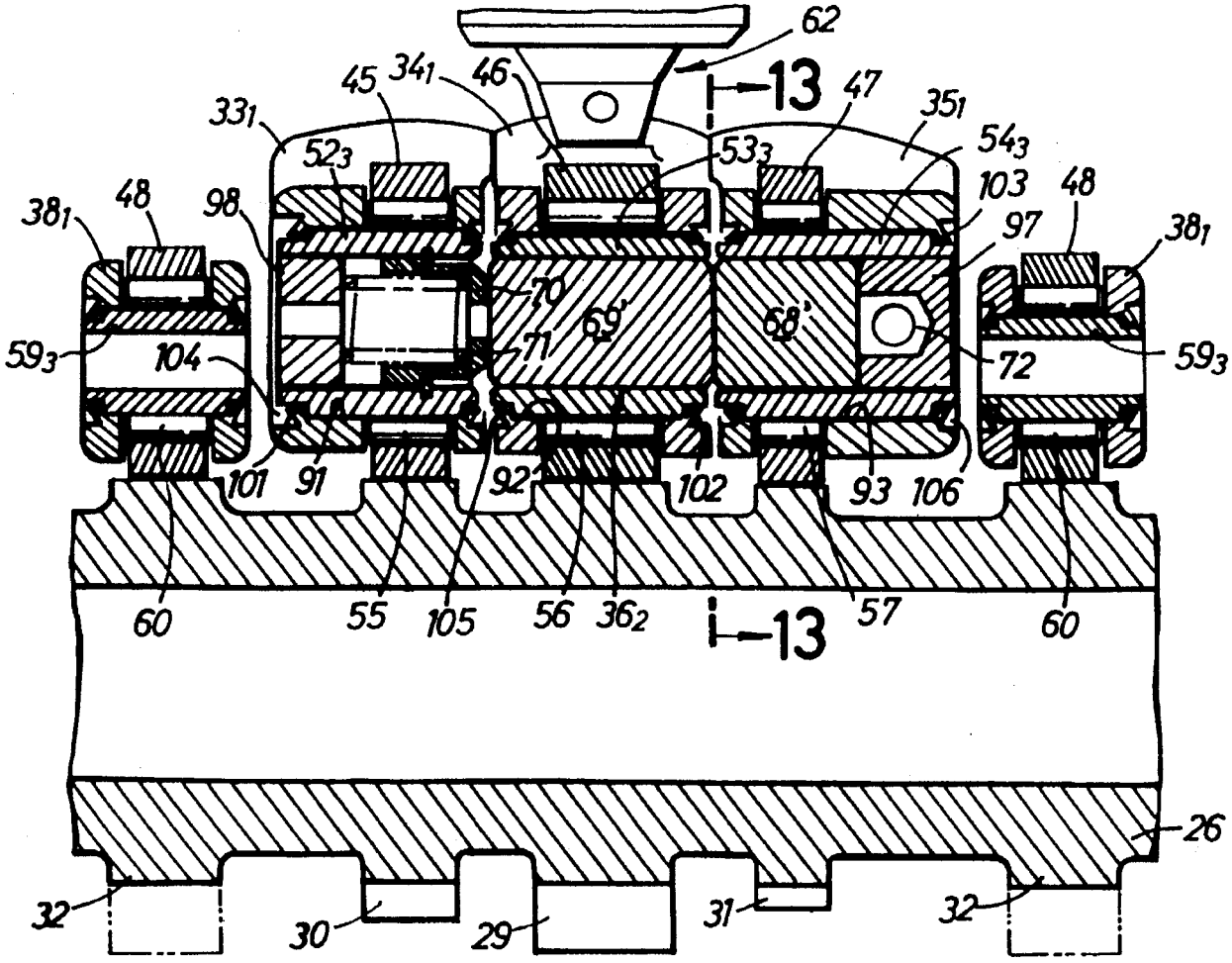
Figure 13:
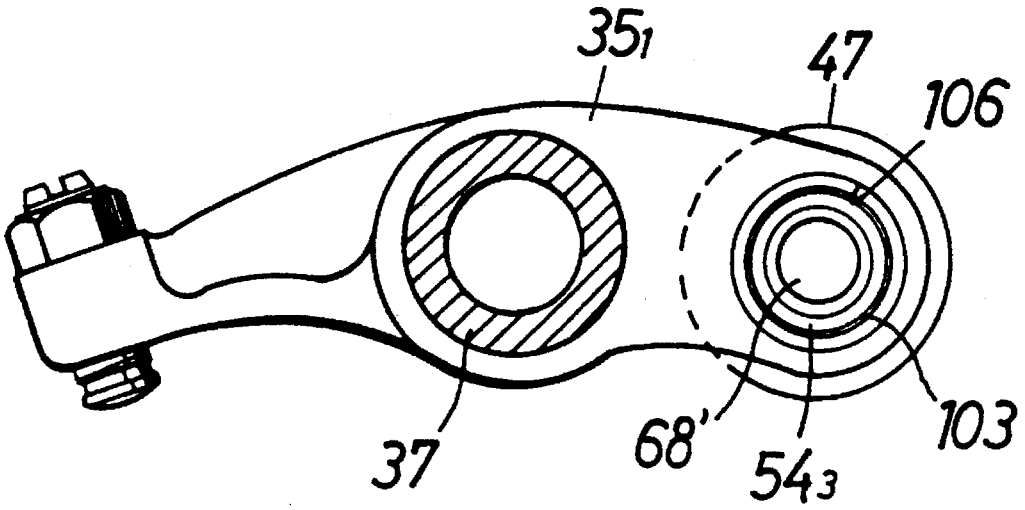

FIGS. 12 and 13 illustrate a third modified embodiment of the sleeve fixing structure.

Sleeves $52_3$, $53_3$, $54_3$ are respectively fixed to intake valve side rocker arms $33_1$, $34_1$, $35_1$, and the outer ends of the sleeves $54_3$, $52_3$ are closed by press-fitting lid members 97 and 98. Sleeves $59_3$ are fixed to both exhaust valve side rocker arms $38_1$.

In order to secure the sleeves $52_3$, $53_3$, $54_3$ to the respective intake valve side rocker arms $33_1$, $34_1$, $35_1$, quenched portions of both ends of fitting holes 91, 92, 93 are removed by the counter boring treatment. Stepped connecting portions 101, 102, 103 directed axially outward are respectively formed at both axial ends of the sleeves $52_3$, $53_3$, $54_3$, and circular recesses 104, 105, 106 recessed axially inward are respectively formed at both ends of the fitting holes 91, 92, 93 and both ends of the sleeves $52_3$, $53_3$, $54_3$. In order to form the connecting portions 101, 102, 103, the quenched portions of both ends of the sleeves $52_3$, $53_3$, $54_3$ may remain as they are. That is, the sleeves $52_3$, $53_3$, $54_3$ may be quenched in the state having the connecting portions 101, 102, 103.

The intake valve side rocker arms $33_1$, $34_1$, $35_1$ are caulked, such as by crushing one of the components in an axial direction with a circular die, so as to connect the inner faces of the ends of the fitting holes 91, 92, 93 in which the quenched portions are removed to the corresponding connecting portions 101, 102, 103 over the entire peripheral surfaces in recesses 104, 105, 106 thereby to secure the sleeves $52_3$, $53_3$, $54_3$ to the intake valve side rocker arms $33_1$, $34_1$, $35_1$. Sleeves $59_3$, $59_3$ are secured to both the exhaust valve side rocker arms $38_1$, $38_1$ in the same manner as the caulked fixing structures of the sleeves $52_3$ to $54_3$ to the intake valve side rocker arms $33_1$ to $35_1$.

The sleeves $52_3$, $53_3$, $54_3$, $59_3$, $59_3$ can reliably be secured to the corresponding rocker arms $33_1$ to $35_1$, $38_1$, $38_1$ even by the third modified embodiment as described above.

Figure 14:
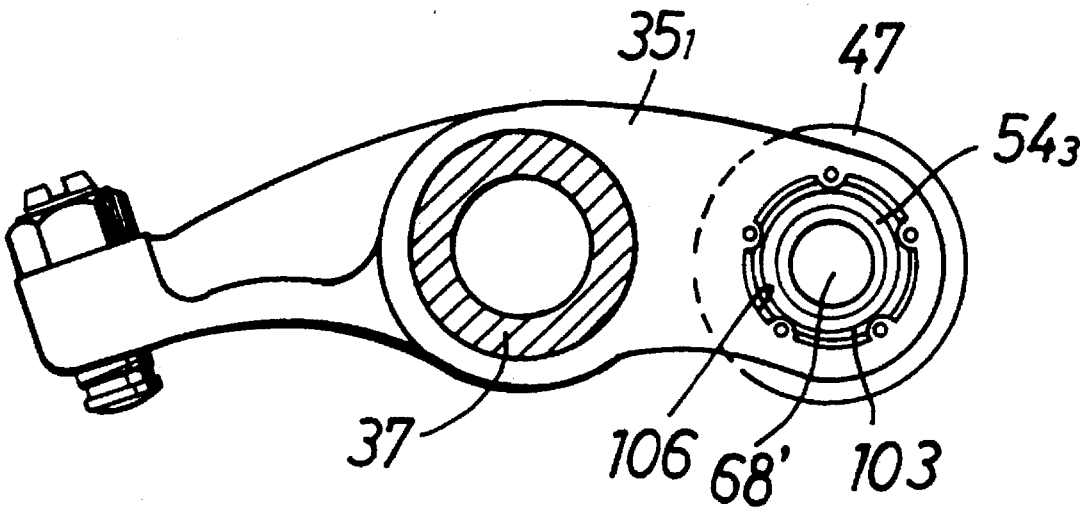
FIG. 14 is a sectional view, similar to FIG. 8, of a fourth modified embodiment of the sleeve fixing structure.

FIG. 14 illustrates a fourth modified embodiment of the sleeve fixing structure. Rocker arms $33_1$, $34_1$, $35_1$, $38_1$, $38_1$ may be caulked at a plurality of positions in a circumferential direction and connected to sleeves $52_3$ to $54_3$, $59_3$, $59_3$.

Figure 15:
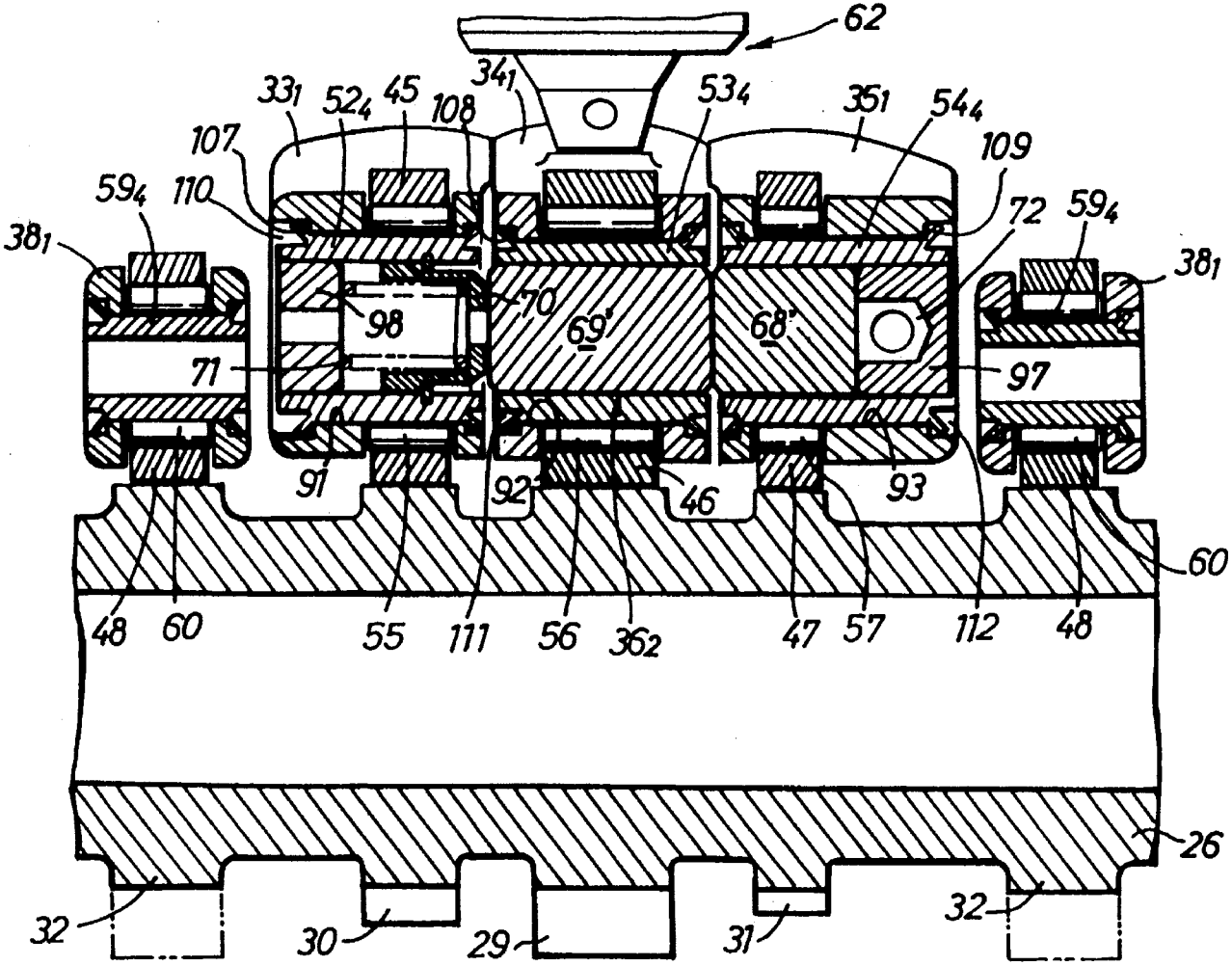
FIG. 15 is a sectional view, similar to FIG. 8, of a fifth modified embodiment of the sleeve fixing structure.

FIG. 15 illustrates a fifth modified embodiment of the sleeve fixing structure. In securing the sleeves $52_4$, $53_4$, $54_4$ to first to third intake valve side rocker arms $33_1$ to $35_1$, quenched portions of both axial ends of the sleeves $52_4$, $53_4$, $54_4$ are removed by the counter boring treatment. Stepped connecting portions 107, 108, 109 directed axially outward are formed at both ends of fitting holes 91, 92, 93 and both ends of the sleeves $52_4$, $53_4$, $54_4$. In order to form the connecting portions 107, 108, 109, quenched portions of both ends of the rocker arms $33_1$, $34_1$, $35_1$ may be quenched in the state having the connecting portions 107, 108, 109.

In this state, outer faces of the ends of the sleeves $52_4$, $53_4$, $54_4$ in which inner peripheral edges of the recesses 110, 111, 112, i.e., quenched portions are removed, are caulked to be connected in these recesses over the entire peripheral surfaces of the corresponding connecting portion 107, 108, 109 thereby to secure the sleeves $52_4$, $53_4$, $54_4$ to the respective intake valve side rocker arms $33_1$ to $35_1$. Sleeves $59_4$, $59_4$ are secured to both exhaust valve side rocker arms $38_1$ and $38_1$ in the same manner.

Figure 16:
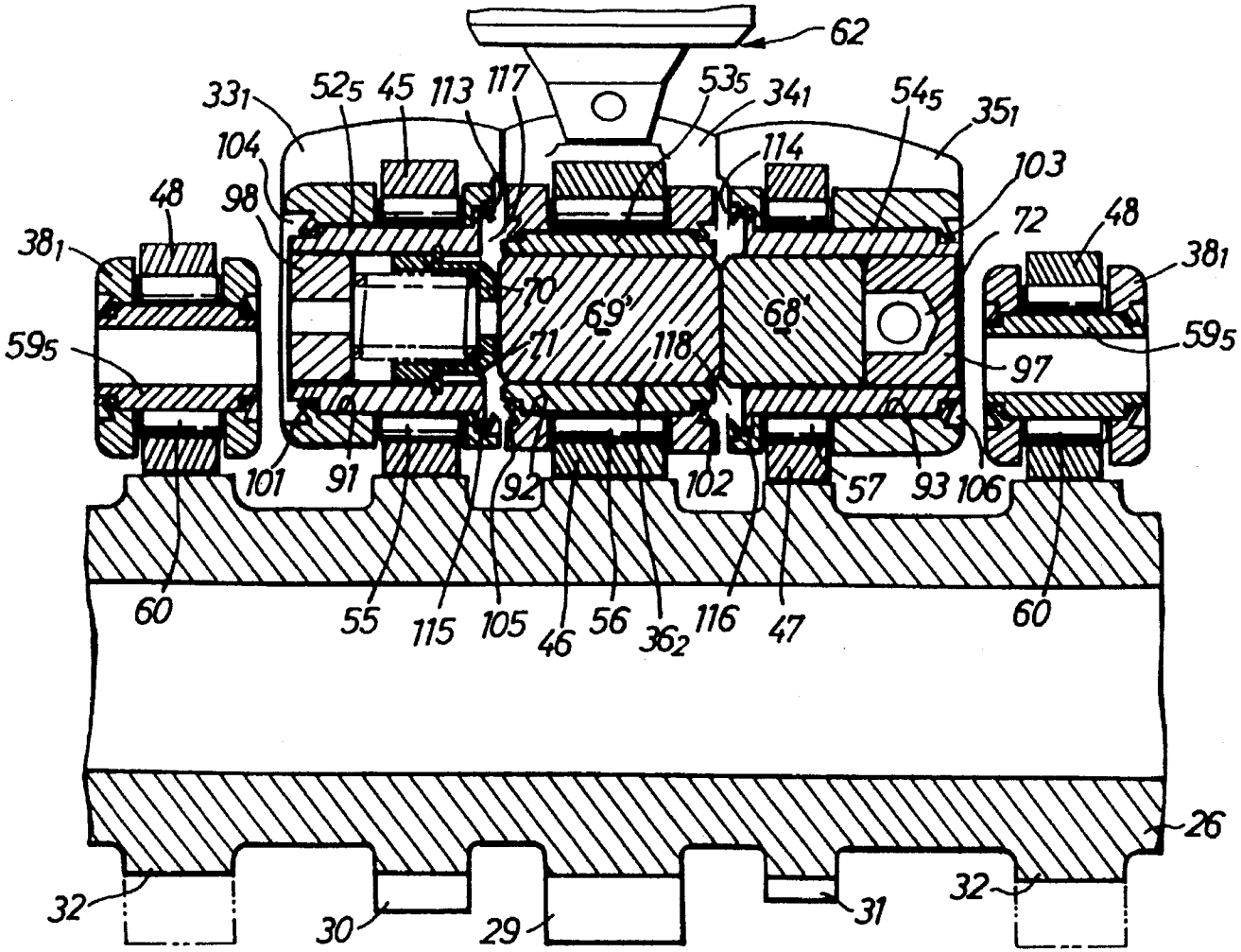
FIG. 16 is a sectional view, similar to FIG. 8, of a sixth modified embodiment of the sleeve fixing structure.

FIG. 16 illustrates a sixth modified embodiment of the sleeve fixing structure.

Sleeves $52_5$ and $54_5$ are secured to first and third intake valve side rocker arms $33_1$ and $35_1$, and a sleeve $53_5$ is secured to a second intake valve side rocker arm $34_1$ similar to the third modified embodiment of FIGS. 12 and 13. The sleeves $59_5$ and $59_5$ are secured to both exhaust valve side rocker arms $38_1$, $38_1$ similar to the third modified embodiment of FIGS. 12 and 13.

In order to secure the sleeves $52_5$ and $54_5$ to the first and third intake valve side rocker arms $33_1$ and $35_1$, quenched portions of both ends of fitting holes 91 and 93 are removed by the counter boring treatment so that stepped portions 113 and 114 directed axially outward are formed at one end of each of the fitting holes 91 and 93. Connecting portions 115 and 116 extended radially outward for being supported on the stepped portions 113 and 114 are provided at axial one end of each of the sleeves $52_5$ and $54_5$ and stepped connecting portions $52_5$ and $54_5$ directed axially outward are formed at the other axial end of each of the sleeves $52_5$ and $54_5$. Thus, circular recesses 117 and 118 recessed axially inward are formed on one end of each of the fitting holes 91, 93 and one end of each of the sleeves $52_5$ and $54_5$, and circular recesses 104 and 106 recessed axially inward are formed on the other end of each of the fitting holes 91 and 93 and the other end of each of the sleeves $52_5$ and $54_5$. Further, the quenched portions of the connecting portions 115, 116 of the axial one end and the connecting portions 101, 103 of the axial other end of each of the sleeves $52_5$ and $54_5$ may remain.

The rocker arms $33_1$ and $35_1$ are caulked at one end of each of the fitting holes 91 and 93 such that the arms can be connected to the connecting portions 115 and 116 to be supported by the stepped portions 113 and 114. The rocker arms $33_1$ and $35_1$ are caulked at the other end of the fitting holes 91 and 93 such that the outer peripheral edges of the recesses 104 and 106 are connected to the connecting portions 101 and 103. Therefore, the sleeves $52_5$ and $54_5$ are secured to the respective rocker arms $33_1$ and $35_1$.

According to the sixth modified embodiment, the connecting portions 115 and 116 are supported by the stepped portions 113 and 114 thereby to consistently determine the axial positions of the sleeves $52_5$ and $54_5$.

Figure 17:
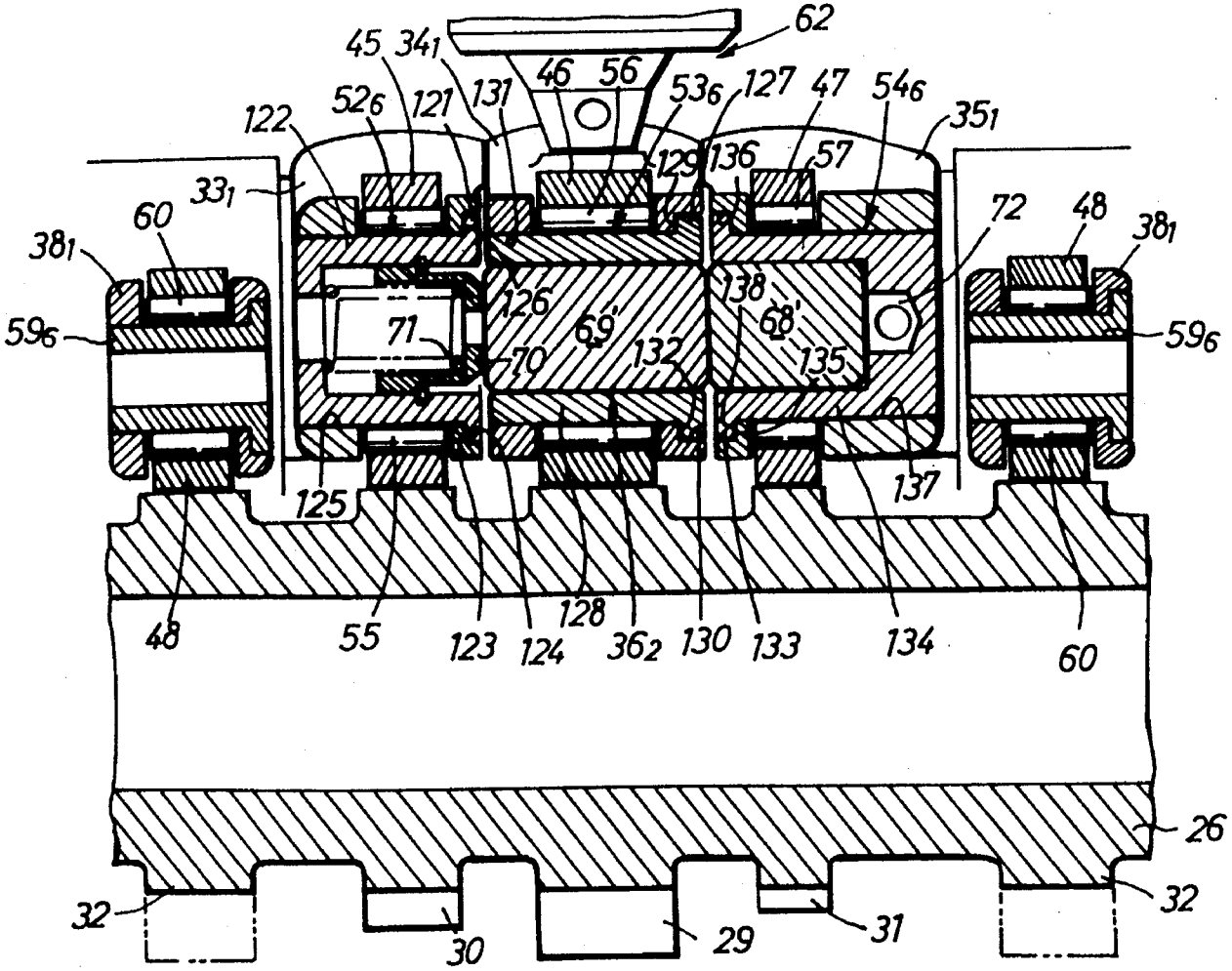
FIG. 17 is a sectional view, similar to FIG. 8, of a seventh modified embodiment of the sleeve fixing structure.

FIG. 17 illustrates a seventh modified embodiment of the sleeve fixing structure. Stepped cylindrical sleeves $52_6$, $53_6$, $54_6$ are fixedly press-fitted into first to third intake valve side rocker arms $33_1$, $34_1$, $35_1$. The sleeve $52_6$ is provided at one end thereof with a large-diameter press-fitting portion 121, and a small-diameter support portion 122 coaxially connected to the large-diameter press-fitted portion 121 through a stepped portion 123. The sleeve $52_6$ is formed into a stepped bottomed cylindrical shape closed at the other end thereof. The first intake valve side rocker arm $33_1$ is provided with, sequentially from the side of the second intake valve side rocker arm $34_1$, a large-diameter press-fitted hole 124 in which the large-diameter press-fitted portion 121 is press-fitted, and a small-diameter fitting hole 125 in which the support portion 122 is lightly press-fitted. Both the holes 124 and 125 are coaxially provided through a stepped portion 126 which can abut against the stepped portion 123. The sleeve $52_1$ is secured to the first intake valve side rocker arm $33_1$ by press-fitting the large-diameter press-fitted portion 121 into the press-fitting hole 124 and by lightly press-fitting the supporting portion 122 into the fitting hole 125. And a rotor 45 is supported on the supporting portion 122 of the sleeve $52_6$ through a plurality of rollers 55.

The sleeve $53_6$ is provided at one end with a large-diameter press-fitted portion 127, a small-diameter supporting portion 128 is coaxially connected to the large-diameter press-fitted portion 127 through a stepped portion 129, and the sleeve $53_6$ thereby is formed into a stepped cylindrical shape opened at both ends. The second intake valve side rocker arm $34_1$ is provided with, sequentially from the side of the third intake valve side rocker arm $35_1$, a press-fitting hole 130 in which the large-diameter press-fitted portion 127 is press-fitted, and a small-diameter fitting hole 131 in which the supporting portion 128 is lightly press-fitted, in a coaxial manner, through a stepped portion 132 which can abut against the stepped portion 129. The sleeve $53_6$ is secured to the second intake valve side rocker arm $34_1$ by press-fitting the large-diameter press-fitted portion 127 in the press-fitting hole 130 and by lightly press-fitting the supporting portion 128 in the fitting hole 131, and a rotor 46 is supported on the supporting portion 128 of the sleeve $53_6$ through a plurality of rollers 56.

The sleeve $54_6$ is provided at one end with a large-diameter portion 133, a small-diameter supporting portion 134 is coaxially connected to the large-diameter press-fitted portion 133 through a stepped portion 135, and the sleeve $54_6$ thereby is formed into a stepped bottomed cylindrical portion shape closed at the other end. The third intake valve side rocker arm $35_1$ is provided with, sequentially from the side of the second intake valve side rocker arm $34_1$, a press-fitting hole 136 in which the large-diameter press-fitted portion 133 is press-fitted and a small-diameter fitting hole 137 in which the supporting portion 134 is lightly press-fitted, in a coaxial manner, through a stepped portion 138 which can abut against the stepped portion 135. The sleeve $54_6$ is secured to the third intake valve side rocker arm $35_1$ by press-fitting the large-diameter press-fitted portion 133 in the press-fitting hole 136 and by lightly press-fitting the supporting portion 134 in the fitting hole 137, and a rotor 47 is supported on the supporting portion 134 of the sleeve $54_6$ through a plurality of rollers 57.

Further, the sleeves $59_6$ are secured to both exhaust valve side rocker arms $38_1$ and $38_1$ in the same manner as the fixing structures of the sleeves $52_6$ to $54_6$ to the respective intake valve side rocker arms $33_1$ to $35_1$.

According to the seventh modified embodiment as described above, the sleeves $52_6$, $53_6$, $54_6$ are secured to the respective rocker arms $33_1$, $34_1$, $35_1$ with rigidity sufficient to endure against frictional forces to be generated upon movements of switchover pins 68' and 69' by the operative-connection switchover mechanism $36_2$. In this case, any distortions to be generated on the inner surfaces of the sleeves $52_6$, $53_6$, $54_6$ are suppressed to a small value by press-fitting only the large-diameter press-fitted portions 121, 127, 133 thereby to obtain smooth movements of the switchover pins 68' and 69' Further, since the rotors 45, 46, 47 are supported on the supporting portions 122, 128, 134 of the sleeves $52_6$, $53_6$, $54_6$ through the rollers 55, 56, 57, which supporting portions 122, 128, 134 are only lightly press-fitted into the rocker arms whereby no distortion occurs, the rotors are supported by the rollers in a precise manner. Since the large-diameter potions 121, 133 of the sleeves $52_6$, $54_6$ are disposed at the side of the second intake valve side rocker arm $34_1$, protruding amounts of the sleeves $52_6$, $54_6$ toward the second intake valve side rocker arm $34_1$ at the time of press-fitting the sleeves $52_6$, $54_6$ can be controlled, and interference of the sleeves $52_6$, $54_6$ toward the second intake valve side-rocker arm $34_1$ can be reliably prevented.

Figure 18:
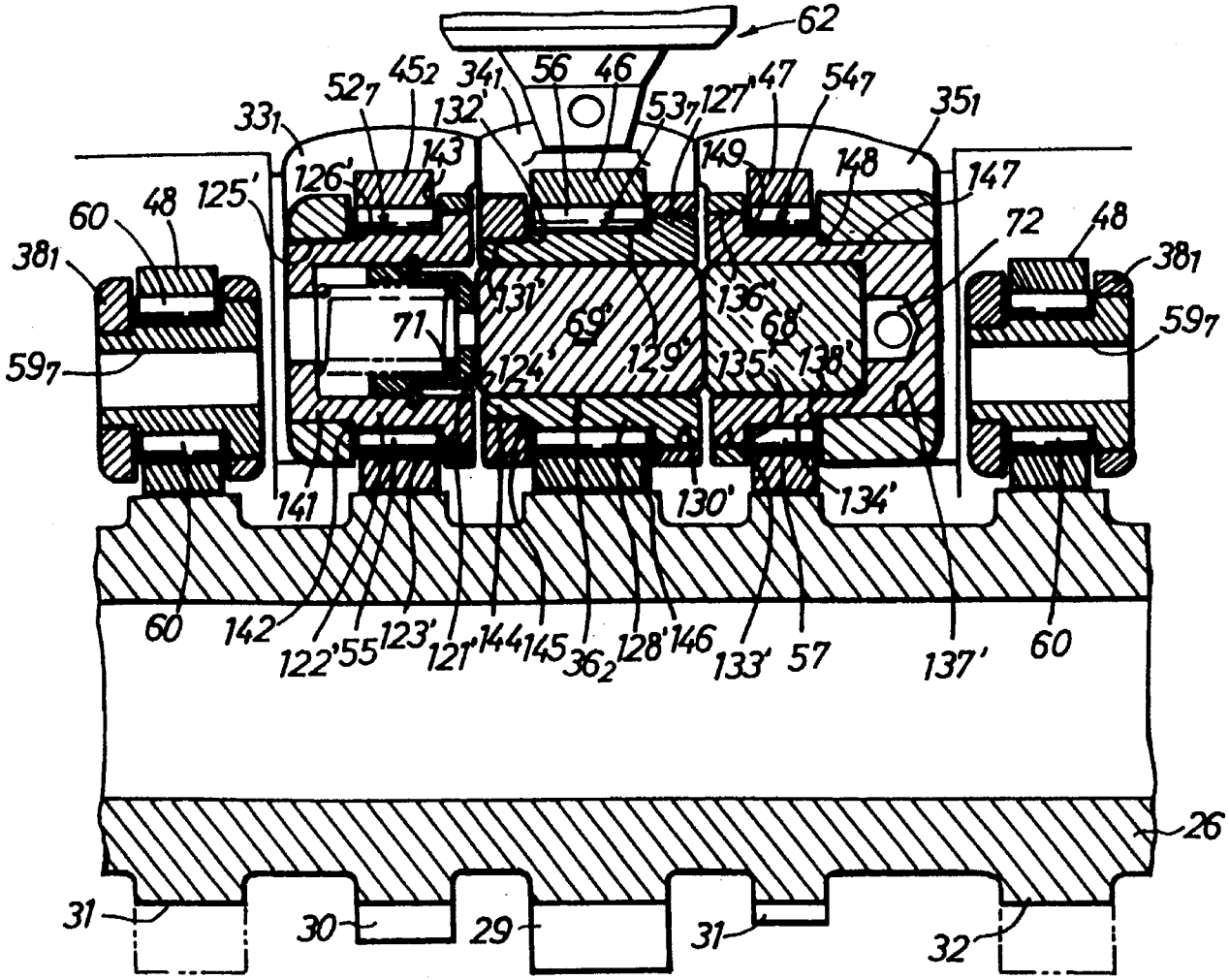
FIG. 18 is a sectional view, similar to FIG. 8, of an eighth modified embodiment of the sleeve fixing structure.

FIG. 18 illustrates an eighth modified embodiment of the sleeve fixing structure. Sleeves $52_7$, $53_7$, $54_7$ are press-fitted into intake valve side rocker arms $33_1$ to $35_1$, and sleeves $59_7$, $59_7$ are secured to both exhaust valve side rocker arms $38_1$ and $38_1$ in the same manner.

The sleeve $52_7$ includes a large-diameter press-fitted portion 121' at its one end, a small-diameter supporting portion 122' coaxially connected to the large-diameter press-fitted portion 121' through a stepped portion 123', and an engaging portion 141 coaxially connected to the supporting portion 122' through a stepped portion 142 to be of a further smaller diameter than the supporting portion 122', and is formed into a stepped bottomed cylindrical shape closed at the other end. The first intake valve side rocker arm $33_1$ is provided with, sequentially from the side of the second intake valve side rocker arm $34_1$, a press-fitting hole 124' in which the large-diameter press-fitted portion 121' is press-fitted, and a small-diameter fitting hole 125' in which the engaging portion 141 is lightly press-fitted, in a coaxial manner, through the stepped portion 126' to be engaged with the stepped portion 142. A slot 143 for receiving a rotor $45_2$ and rollers 55 is provided in the first intake valve side rocker arm $33_1$ so as to be between the fitting hole 125' and the press-fitting hole 124. The sleeve $52_7$ is secured to the first intake valve side rocker arm $33_1$ by press-fitting the large-diameter press-fitted portion 121' into the press-fitting hole 124' and by lightly press-fitting the engaging portion 141 in the fitting hole 125', with the rotor 45 being supported on a supporting portion 122' of the sleeve $52_7$ through a plurality of rollers 55.

The sleeve $53_7$ includes a large-diameter press-fitted portion 127' at one end thereof, a small-diameter supporting portion 128' coaxially connected to the large-diameter press-fitted portion 127' through a stepped portion 129', and an engaging portion 144 coaxially connected to the supporting portion 128' through a stepped portion 145 to be of a further smaller diameter than the supporting portion 128', and is formed in a stepped cylindrical shape opened at both ends. The second intake valve side rocker arm $34_1$ is provided with, sequentially from the side of the third intake valve side rocker arm $35_1$, a press-fitting hole 130' in which the large-diameter press-fitted portion 127' is press-fitted, and a small-diameter fitting hole 131' in which the engaging portion 144 is lightly press-fitted, in a coaxial manner, through a stepped portion 132' to be engaged with the stepped portion 145. A slot 146 for receiving a rotor 46 and rollers 56 is provided in the second intake valve side rocker arm $34_1$ so as to be between the fitting hole 131' and the press-fitting hole 130' The sleeve $53_7$ is secured to the second intake valve side rocker arm $34_1$ by press-fitting the large-diameter press-fitted portion 127' in the press-fitting hole 130' and by lightly press-fit the engaging portion 144 in the fitting holes 131', and the rotor 46 is supported on the supporting portion 128' of the sleeve $53_7$ through a plurality of rollers 56.

The sleeve $54_7$ includes a large-diameter press-fitted portion 133' at one end thereof, a small-diameter supporting portion 134' coaxially connected to the large-diameter press-fitted portion 133' through a stepped portion 135', and an engaging portion 147 coaxially connected to the supporting portion 134' through a stepped portion 148 to be of a further smaller diameter than the supporting portion 134', and is formed in a stepped bottomed cylindrical shape closed at the other end. The third intake valve side rocker arm $35_1$ is provided with a press-fitting hole 136' for press-fitting the large-diameter press-fitted portion 133' into and a small-diameter fitting hole 137' for lightly press-fitting the engaging portion 147 into are coaxially provided sequentially from the side of the second intake valve side rocker arm $34_1$ through a stepped portion 138' to be engaged with the stepped portion 148. A slot 149 for receiving a rotor 47 and rollers 57 is provided in the third intake valve side rocker arm $35_1$ so as to be between the press-fitting hole 136' and fitting hole 137' The sleeve $54_7$ is secured to the third intake valve side rocker arm $35_1$ by press-fitting the large-diameter press-fitted portion 133' into the press-fitting hole 136' and by lightly press-fitting the supporting portion 134' in the fitting hole 137', and the rotor 47 is supported on the supporting portion 134' of the sleeve $54_7$ through the plurality of rollers 57.

Thus, the same effects and advantages can be provided by the eighth modified embodiment as those of the seventh modified embodiment.

Figure 19:
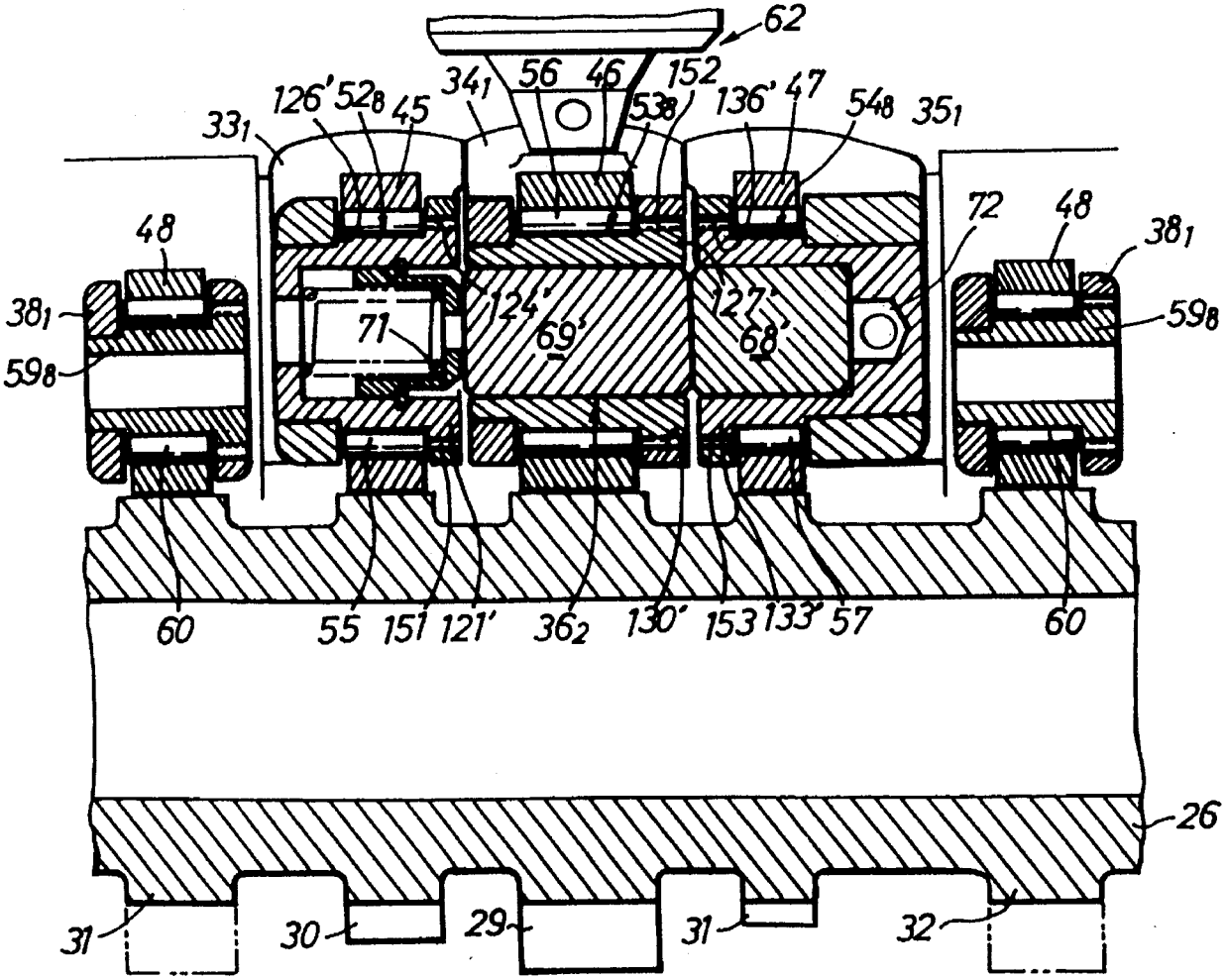
FIG. 19 is a sectional view, similar to FIG. 8, of a ninth modified embodiment of the sleeve fixing structure.

FIG. 19 illustrates a ninth modified embodiment of the sleeve fixing structure. Serration teeth 151, 152, 153 are provided at least at one of the outer surfaces of the large-diameter press-fitted portions 121', 127', 133' at one end of sleeves $52_8$, $53_8$, $54_8$ formed substantially in the same shape as the sleeves $52_7$, $53_7$, $54_7$ of the eighth modified embodiment for those serration teeth to engage and be fixed to the inner surfaces of press-fitting holes 124', 130', 136' of intake valve side rocker arms $33_1$, $34_1$, $35_1$. The sleeves $59_8$, $59_8$ are secured to both exhaust valve side rocker arms $38_1$, $38_1$ in the same manner as the fixing structure of the sleeves $52_8$, $53_8$, $54_8$ to the intake valve side rocker arms $33_1$ to $35_1$.

As described above, the sleeves $52_8$, $53_8$, $54_8$ are reliably prevented from being rotated by serration engagement of the large-diameter press-fitted portions 121', 127', 133' with the rocker arms $33_1$, $34_1$, $35_1$.

Figure 20:
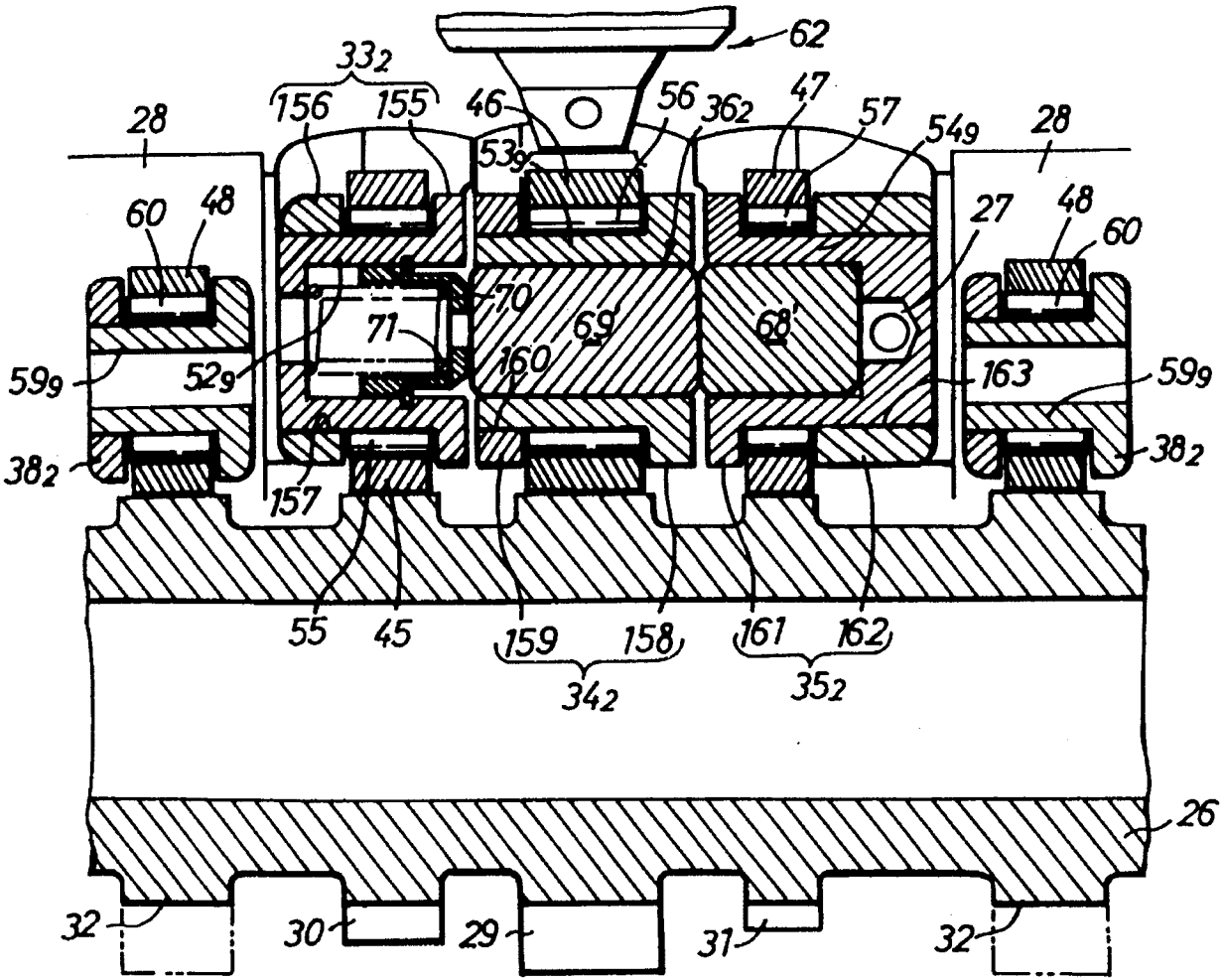
FIG. 20 is a sectional view, similar to FIG. 8, of a third embodiment of the invention.

FIG. 20 illustrates a third embodiment of the present invention, and the same or similar reference numerals are given to components corresponding to those of the previous embodiments.

A first intake valve side rocker arm $33_2$ includes a first arm member 155 rockably supported on the intake valve side rocker arm shaft 37 (see FIGS. 2 to 4), and a second arm member 156 supported by the rocker arm shaft 37 is operatively connected to one of the intake valves adjacent to the first arm member 155 on the outside along an axial direction of the intake valve side rocker arm shaft 37. At a tip end of the first arm member 155, a bottomed cylindrical sleeve $52_9$ having an axis parallel with the rocker arm shaft 37 and closed at its tip end is integrally projected toward the second arm member 156. The second arm member 156 includes a fitting hole 157 for press-fitting therein a tip end of the sleeve $52_9$. The tip end of the sleeve $52_9$, i.e., the closed end is lightly press-fitted in the fitting hole 157 thereby to connect the first and second arm members 155 and 156.

A second intake valve side rocker arm $34_2$ includes a first arm member 158 supported by the intake valve side rocker arm shaft 37 adjacent to the third intake valve side rocker arm $35_2$, and a second arm member 159 supported by the rocker arm shaft 37 adjacent to the first arm member 158 at the side of the first intake valve side rocker arm $33_2$. On the first arm member 158, a cylindrical sleeve $53_9$ opened at both ends is integrally projected toward the second arm member 159, and a fitting hole 160 for lightly press-fitting the end of the sleeve $53_9$ into is provided in the second arm member 159. The tip end of the sleeve $53_9$ is lightly press-fitted into the fitting hole 160 thereby to connect the first and second arm members 158 and 159.

A third intake valve side rocker arm $35_2$ includes a first arm member 161 supported by the intake valve side rocker arm shaft 37, and a second arm member 162 supported by the rocker arm shaft 37 adjacent to the first arm member 161 on the outside along an axial direction of the rocker arm shaft 37. The second arm member 162 is operatively connected to the other intake valve 16. On the first arm member 161, a bottomed cylindrical sleeve $54_9$ closed at the end is integrally projected toward the second arm member 162, and a fitting hole 163 for lightly press-fitting the end of the sleeve $54_9$ into is provided in the second arm member 162. The tip end of the sleeve $54_9$, i.e., the closed end, is lightly press-fitted in the fitting hole 163 thereby to connect the first and second arm members 161 and 162.

Exhaust valve side rocker arms $38_2$ and $38_2$ are also constructed similar to the intake valve side rocker arms $33_2$ to $35_2$.

In the intake valve side rocker arms $33_2$, $34_2$, $35_2$, base ends of the first and second arm members 155, 156; 158, 159; 161, 162 are adjacently disposed so as to be interposed between both the holders 28 and 28 thereby to restrain movements of the respective arm members along an axis of the intake valve side rocker arm shaft 37.

In the intake valve side rocker arms $33_2$, $34_2$, $35_2$, the second arm member 156, 159, 162 may be formed of an aluminum alloy so as to reduce the weight, and the first arm members 155, 158, 161 that are integral with the sleeves $52_9$, $53_9$, $54_9$ are preferably formed of metal having more rigidity than that of aluminum alloy, such as steel.

According to the third embodiment, the sleeves $52_9$, $53_9$, $54_9$ have sufficient rigidity to resist frictional forces accompanied by the movements of the switchover pins 68', 69' of the operative-connection switchover mechanism $36_2$ for the intake valve side rocker arms $33_2$, $34_2$, $35_2$. Since the sleeves $52_9$ and $54_9$ are only lightly press-fitted at the closed ends in the fitting holes 157 and 163, distortions are avoided at those portions for guiding the sliding of the switchover pins 68', 69' and the restrain member 70. For the second intake valve side rocker arm $34_2$, the sleeve $53_9$ is only lightly press-fitted in the fitting hole 160 to avoid distortion to allow the second switchover pin 69' to be slid. In this case, any distortion at the time of press-fitting can be suppressed to a small value and yet the sleeve $53_9$ cannot be displaced inadvertently from the fitting hole 160 because the first and third intake valve side rocker arms $33_2$, $35_2$ are on both sides of the second intake valve side rocker arm $34_2$.

Further, the rocker arms $33_2$, $34_2$, $35_2$ can be assembled in advance by lightly press-fitting the sleeves $52_9$, $53_9$, $54_9$ into the fitting holes 157, 160, 163 for ease in assembling them to the intake valve side rocker arm shaft 37, thereby improving the assembling process.

It should be noted that for the first and third intake valve side rocker arms $33_2$, $35_2$ the sleeves $52_9$, $54_9$ may be provided on either of the first and second arm members 155, 156; 161, 162.

Figure 21:
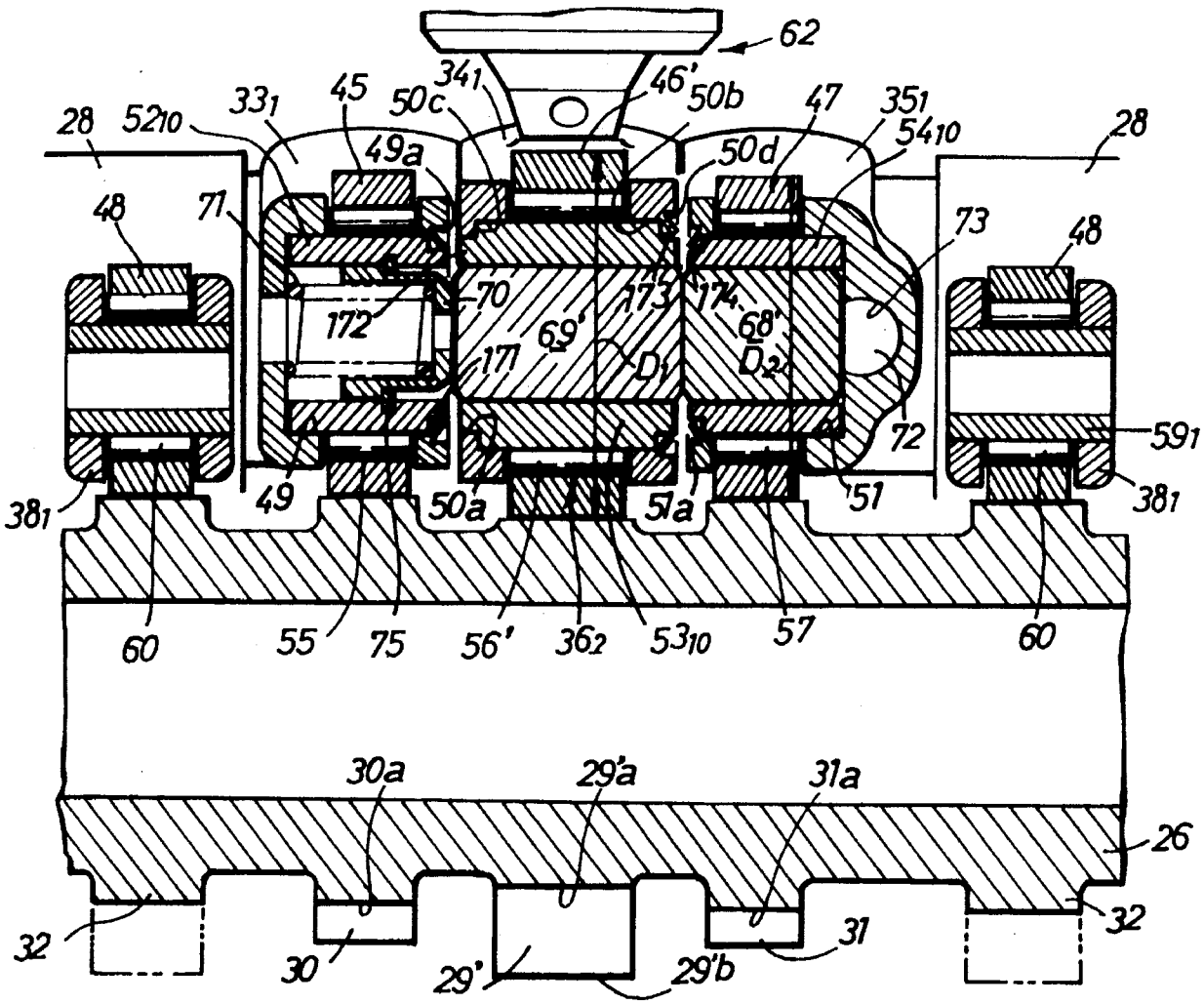
FIG. 21 is a sectional view, similar to FIG. 8, of a fourth embodiment of the invention.

FIG. 21 illustrates a fourth embodiment of the invention, and the same or similar reference numerals are given to components corresponding to those of the previous embodiments.

A high speed cam 29' for the intake valves to be provided on the cam shaft 26 includes a base circle portion **29'*a* having a smaller diameter than those of base circle portions 30*a*, 31*a* of the intermediate speed cam 30 and the low speed cam 31 for the intake valves provided on the cam shaft 26 at opposite sides of the cam 29', and a lobe 29'*b* extended radially outward from the base circle portion 29'*a***.

Secured to a first intake valve side rocker arm $33_1$ is a cylindrical sleeve $52_{10}$ for rotatably supporting a cylindrical rotor 45 in rolling contact with the intermediate speed cam 30 for the intake valves. Secured to a second intake valve side rocker arm $34_1$ is a cylindrical sleeve $53_{10}$ for rotatably supporting a rotor 46' in rolling contact with the high speed cam 29' for the intake valve. Secured to a third intake valve side rocker arm $35_1$ is a cylindrical sleeve $54_{10}$ for rotatably supporting a rotor 47 in rolling contact with the low speed cam 31 for the intake valves. In addition, the outer diameter $D_1$ of the rotor 46' in rolling contact with the high speed cam 29' for the intake valves is larger than the outer diameters $D_2$ of the other rotors 45, 47. The sleeves $52_{10}$, $53_{10}$, $54_{10}$ have the same inner diameter. However, the outer diameter of the sleeve $53_{10}$ is formed larger than those of the sleeves $52_{10}$ and $54_{10}$.

In the first intake valve side rocker arm $33_1$, a bottomed fitting hole 49 opened on the side of the second intake valve side rocker arm $34_1$ is provided in parallel with the intake valve side rocker arm shaft 37. In the second intake valve side rocker arm $34_1$, a small-diameter fitting hole 50*a* is provided at the side of the first intake valve side rocker arm $33_1$ and a large-diameter fitting hole 50*b* forming a stepped portion 50*c* between the hole 50*b* itself and the small-diameter fitting hole 50*a* is coaxially provided. In the third intake valve side rocker arm $35_1$, a bottomed fitting hole 51 opened on the side of the second intake valve side rocker arm $34_1$ is provided in parallel with the intake valve side rocker arm shaft 37. Further, the fitting hole 49 is provided with a recess 49*a* recessed axially inward at an end thereof near the second intake valve side rocker arm $34_1$, the hole 50*b* is provided with a recess 50*d* recessed axially inward at an end thereof near the third intake valve side rocker arm $35_1$, and the hole 51 is provided with a recess 51*a* recessed axially inward at an end thereof near the second intake valve side rocker arm $34_1$.

A locking stepped portion 171 facing the side of the second intake valve side rocker arm $34_1$ is annularly provided at the outer face of the sleeve $52_{10}$ on the side of the second intake valve side rocker arm $34_1$. The sleeve $53_{10}$ is provided at its one end with a small-diameter portion 172 fitted in the small-diameter fitting hole 50*a*, and is fitted in the large-diameter fitting hole 50*b*. A locking stepped portion 173 facing the side of the third intake valve side rocker arm $35_1$ is annularly provided at the outer face of the other end of the sleeve $53_{10}$. Further, a locking stepped portion 174 facing the side of the second intake valve side rocker arm $34_1$ is annularly provided on the sleeve $54_{10}$ on the outer face of the side of the second intake valve side rocker arm $34_1$, which sleeve $54_{10}$ is mounted in the fitting hole 51.

The sleeve $52_{10}$ is secured to the first intake valve side rocker arm $33_1$ by caulking the inner peripheral surface of the recess 49*a* at the locking stepped portion 171 with the sleeve fitted in the fitting hole 49. The sleeve $53_{10}$ is secured at the large-diameter portion 172 to the second intake valve side rocker arm $34_1$ by caulking the inner peripheral surface of the recess 50*d* at the locking stepped portion 173. The sleeve $54_{10}$ is secured to the third intake valve side rocker arm $35_1$ by caulking the inner peripheral surface of the recess 51*a* at the locking stepped portion 174.

A plurality of rollers 55, 56' 57 are interposed between the sleeves $52_{10}$ to $54_{10}$ and rotors 45, 46', 47 which coaxially surround the sleeves $52_{10}$ to $54_{10}$.

According to the fourth embodiment, the high speed cam 29' is the cam having the largest lift amount for the intake valves 16 among the high speed cam 29', the intermediate speed cam 30, and the low speed cam 31 provided on the cam shaft 26 corresponding to the intake valve side rocker arms $33_1$, $34_1$, $35_1$. The outer diameter $D_1$ of the rotor 46' in rolling contact with the high speed cam 29' is larger than the outer diameters $D_2$ of the other rotors 45, 47. Accordingly, the peripheral speed of the contact surface of the large-diameter rotor 46' with the high speed cam 29' caused by the rotation of the cam shaft 26 is faster than those of the contact surfaces of the small-diameter rotors 45, 47 with the cams 30, 31. Thus, wearing amounts of the contact surface of the rotor 46' with the high speed cam 29' and of the contact surfaces of the rotors 45, 47 with the cam 30, 31 can be substantially equalized, the displacements of the axes of the sleeves $52_{10}$, $53_{10}$, $54_{10}$ are prevented even in the case of operation for a long period, and the switching operation of the operative-connection switchover mechanism $36_2$ can be smoothly maintained. In addition, the outer diameters of the rotors 45, 47 are not increased more than necessary, and the weights are not increased more than required either. Therefore, this construction can contribute to a reduction in the valve operating load. Further, more rollers 56' can be interposed between the sleeve $53_{10}$ and the rotor 46' by increasing the outer diameter of the sleeve $53_{10}$ larger than the outer diameters of the sleeves $52_{10}$, $54_{10}$, and sufficient durability for the relatively large load can be incorporated in the rollers 56'.

Figure 22:
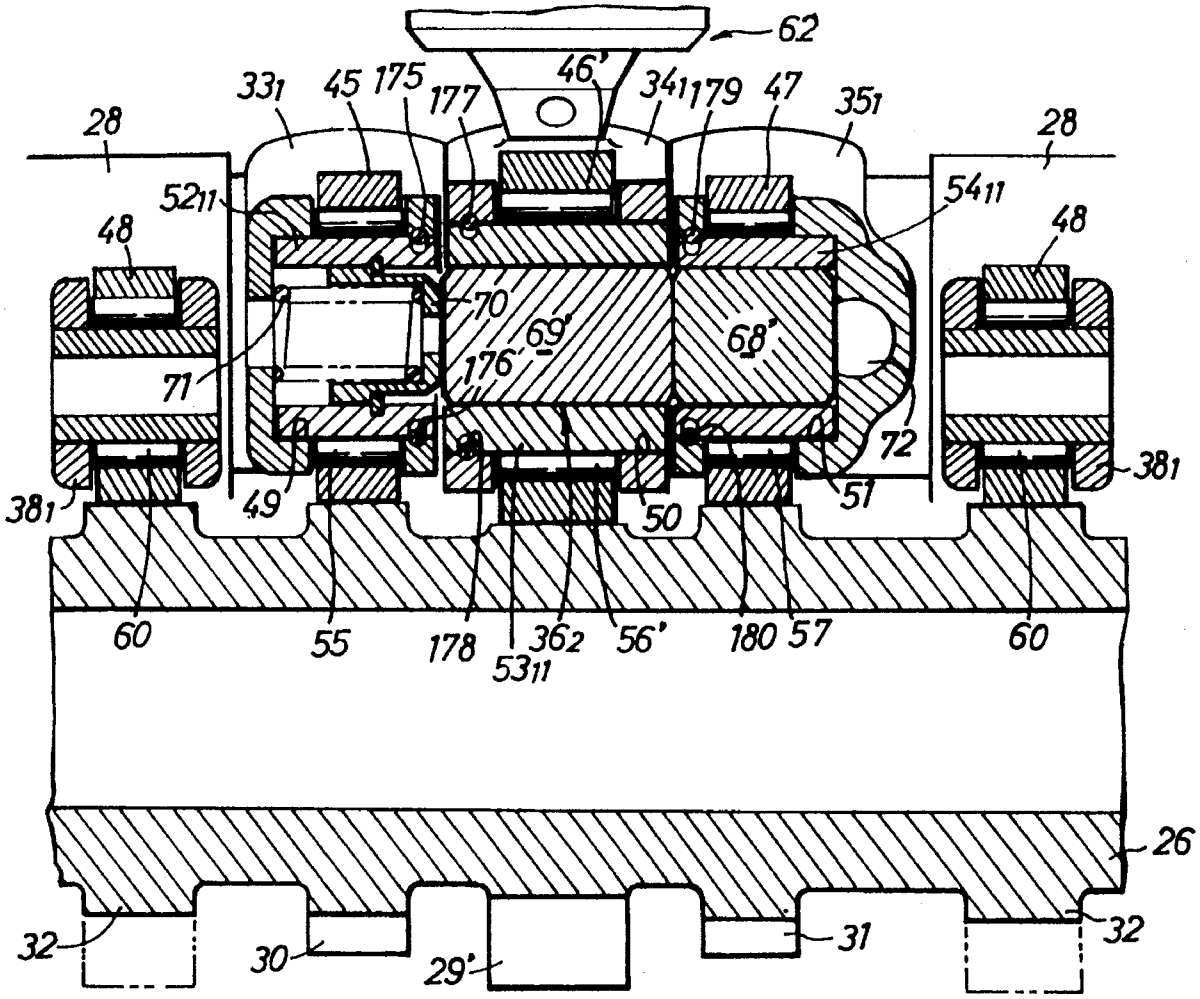
FIG. 22 is a sectional view, similar to FIG. 21, of tenth modified embodiment of the sleeve fixing structure.

FIG. 22 illustrates a tenth modified embodiment of the sleeve fixing structure. A cylindrical sleeve $52_{11}$ for rotatably supporting rotor 45 is secured to a first intake valve side rocker arm $33_1$. A cylindrical sleeve $53_{11}$ for rotatably supporting a rotor 46' is fixedly secured to a second intake valve side rocker arm $34_1$. A cylindrical sleeve $54_{11}$ for rotatably supporting a rotor 47 is secured to a third intake valve side rocker arm $35_1$.

The sleeve $52_{11}$ is fitted in a bottomed fitting hole 49 provided in the first intake valve side rocker arm $33_1$. The sleeve $53_{11}$ is engaged with a fitting hole 50 provided in the second intake valve side rocker arm $34_1$. The sleeve $54_{11}$ is engaged with a fitting hole 51 provided in the third intake valve side rocker arm $35_1$. A C-shaped snap ring 175 mounted on the outer surface of the sleeve $52_{11}$ is engaged with an annular locking groove 176 in the inner surface of the fitting hole 49 thereby to restrain the axial movements of the sleeve $52_{11}$. A C-shaped snap ring 177 mounted on the outer surface of the sleeve $53_{11}$ is engaged with an annular locking groove 178 in the inner surface of the fitting hole 50 thereby to restrain the axial movements of the sleeve $53_{11}$. A C-shaped snap ring 179 mounted on the outer surface of the sleeve $54_{11}$ is engaged with an annular locking groove 180 in the inner surface of the fitting hole 51 thereby to restrain the axial movements of the sleeve $54_{11}$.

Figure 23:
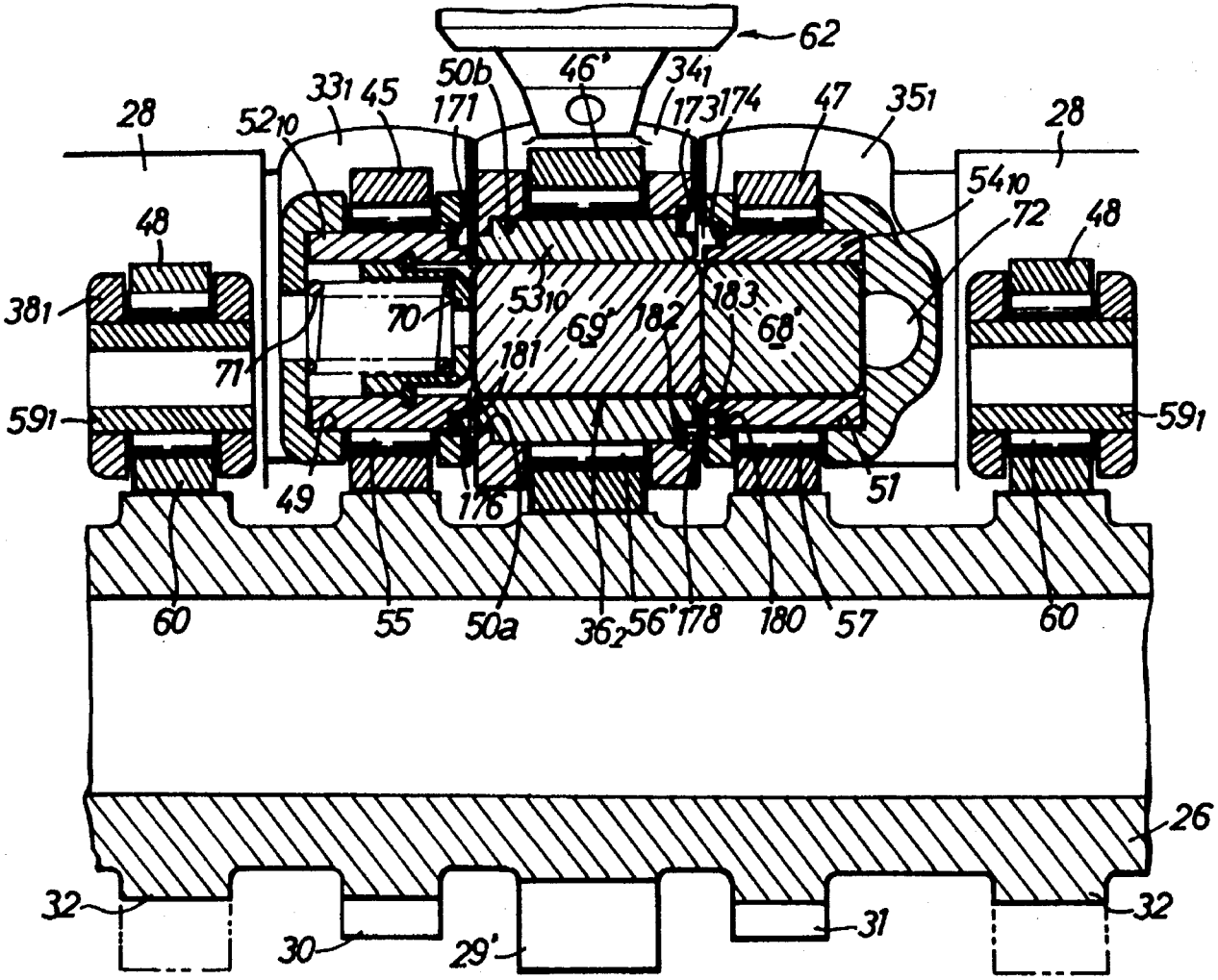
FIG. 23 is a sectional view, similar to FIG. 21, of eleventh modified embodiment of the sleeve fixing structure.

FIG. 23 illustrates an eleventh modified embodiment of the sleeve fixing structure. A cylindrical sleeve $52_{10}$ for rotatably supporting a rotor 45 is fitted in a fitting hole 49 of a first intake valve side rocker arm $33_1$. A ring-like locking member 181 is engaged with a locking stepped portion 171 of the sleeve $52_{10}$. The locking member 181 is fitted into and caulked with the annular locking groove 176 of the fitting hole 49 thereby to secure the sleeve $52_{10}$ to the first intake valve side rocker arm $33_1$. Further, the cylindrical sleeve $53_{10}$ is fitted in the small-diameter fitting hole 50*a* and the large-diameter fitting hole 50*b* of the second intake valve side rocker arm $34_1$. A ring-like locking member 182 is engaged with the locking stepped portion 173 of the sleeve $53_{10}$. The locking member 182 is fitted into and caulked with the annular locking groove 178 of the small-diameter fitting hole 50*a* thereby to secure the sleeve $53_{10}$ to the second intake valve side rocker arm $34_1$. In addition, the sleeve $54_{10}$ is fitted in the fitting hole 51 of the third intake valve side rocker arm $35_1$. A ring-like locking member 183 is engaged with the locking stepped portion 174 of the sleeve $54_1$. The locking member 183 is fitted into and caulked with the annular locking groove 180 of the fitting hole 51 thereby to secure the sleeve $54_{10}$ to the third intake valve side rocker arm $35_1$.

Figure 24:
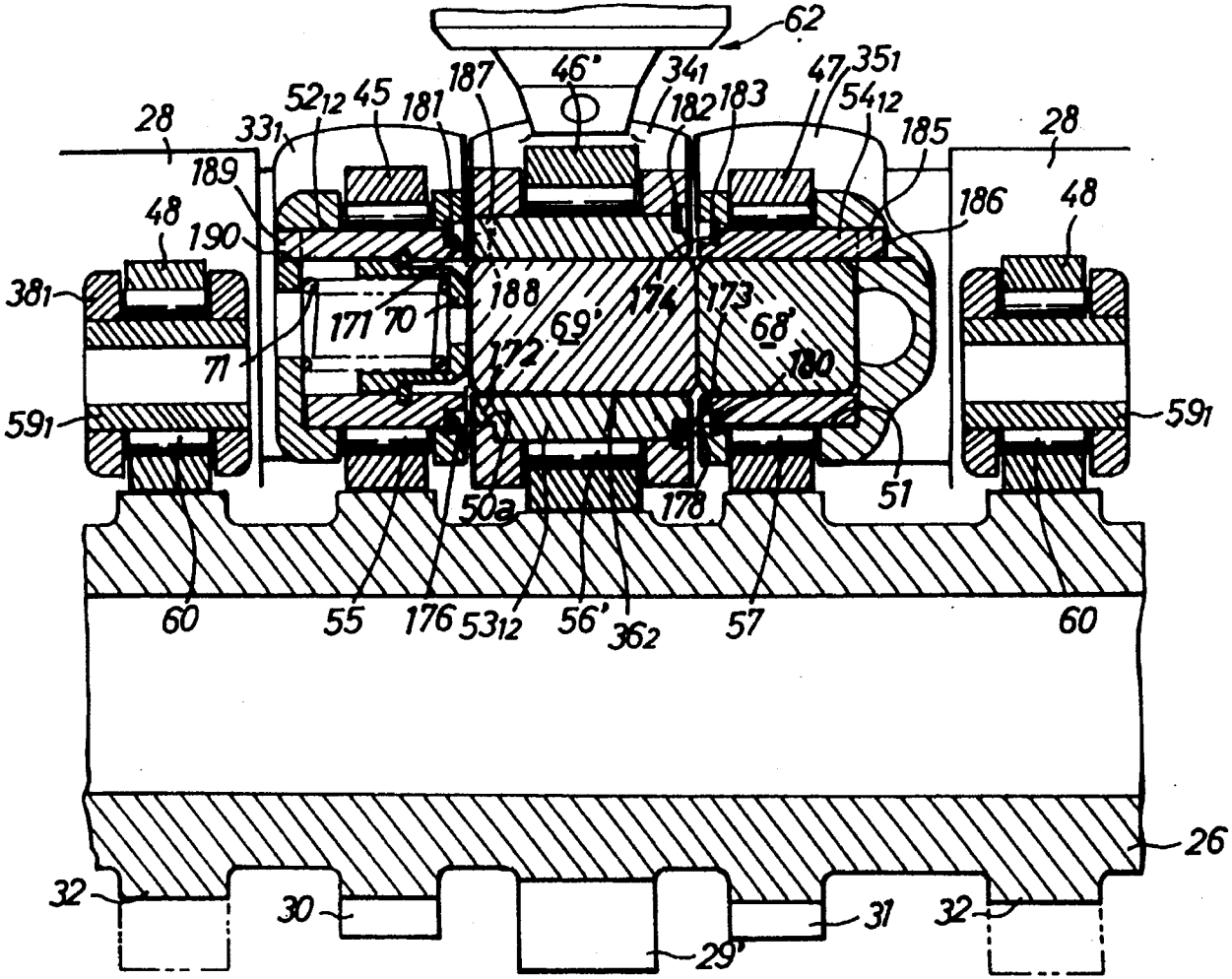
Figure 25:
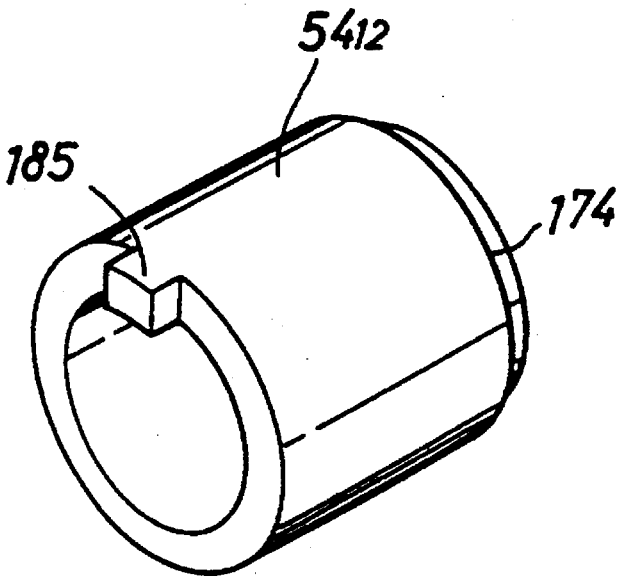
Figure 26:
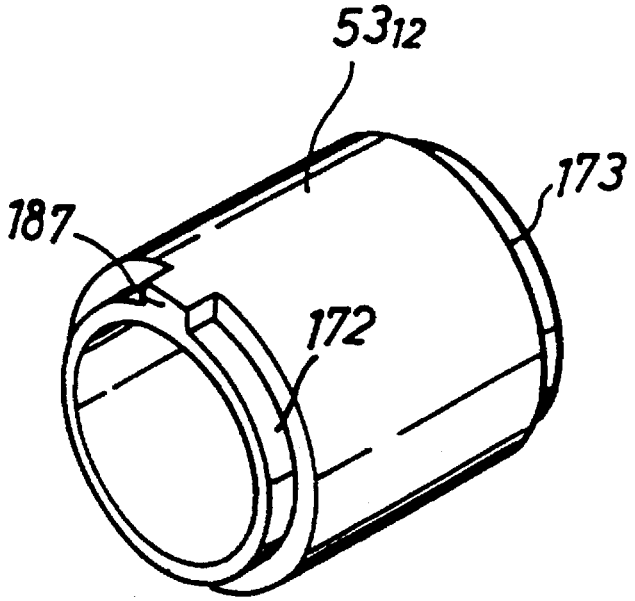

FIGS. 24, 25 and 26 illustrate a twelfth modified embodiment of the sleeve fixing structure. FIG. 24 is a cross-sectional view, FIG. 25 is a perspective view of a sleeve to be fixed to a third intake valve side rocker arm, and FIG. 26 is a perspective view of a sleeve to be fixed to a second intake valve side rocker arm.

A sleeve $52_{12}$ is secured to a first intake valve side rocker arm $33_1$. A sleeve $53_{12}$ is secured to a second intake valve side rocker arm $34_1$. A sleeve $54_{12}$ is secured to a third intake valve side rocker arm $35_1$.

As shown in FIG. 25, the sleeve $54_{12}$ is formed in a cylindrical shape having a locking stepped portion 174 disposed at an end on the side of the second intake valve side rocker arm $34_1$. A fitting protrusion 185 protruding axially outward is provided at the other end of the sleeve $54_{12}$. A bottomed fitting hole 51 in which the sleeve $54_{12}$ is fitted is provided in the third intake valve side rocker arm $35_1$. A fitting recess 186 in which the fitting protrusion 185 is fitted is provided at the closed end of the fitting hole 51. The fitting recess 186 may be a through hole as shown in FIG. 24 or a bottomed hole.

The ring-like locking member 183 is connected to the locking stepped portion 174 of the sleeve $54_{12}$ fitted in the fitting hole 51 by fitting the fitting protrusion 185 into the fitting recess 186. The locking member 183 is fitted into and caulked with the annular locking groove 180 thereby to secure the sleeve $54_{12}$ to the third intake valve see-rocker arm $35_1$ in a state where the sleeve $54_{12}$ is prevented from being rotated around its axis.

As shown in FIG. 26, the sleeve $53_{12}$ is formed in a cylindrical shape and is provided at its one end with a locking stepped portion 173 facing the side of the third intake valve side rocker arm $35_1$ and at the other end with a small-diameter portion 172 to be fitted in the small-diameter fitting hole 50*a* of the second intake valve side rocker arm $34_1$. A connecting protrusion 187 protruding radially outward from the outer surface of the small-diameter portion 172 is provided at the other end of the sleeve $54_{12}$. A connecting recess 188 to which the connecting protrusion 187 is engaged is provided on the inner surface of the small-diameter fitting hole 50*a* provided in the second intake valve side rocker arm $34_1$.

The ring-like locking member 182 is engaged with the locking stepped portion 173 of the sleeve $53_{12}$ with the sleeve $53_{12}$ fitted in the small-diameter fitting hole 50*a* and the large-diameter fitting hole 50*b* such that the connecting protrusion 187 is engaged with the connecting recess 188. The locking member 182 is fitted into and caulked with the annular locking groove 178 thereby to secure the sleeve $53_{12}$ to the second intake valve side rocker arm $34_1$ in a state where the sleeve $53_{12}$ is prevented from being rotated around its axis.

The sleeve $52_{12}$ is formed into a cylindrical shape having at its one end the locking stepped portion 171 facing the side of the second intake valve side rocker arm $34_1$. The sleeve $52_{12}$ is also provided at its outer end with a fitting protrusion 189 protruding axially outward similar to protrusion 185. The bottomed fitting hole 49 in which the sleeve $52_{12}$ is fitted is provided in the first intake valve side rocker arm $33_1$. A fitting recess 190 in which the fitting protrusion 189 is fitted is provided at the closed end of the fitting hole 49. The fitting recess 190 may be a through hole as shown in FIG. 24 or a bottomed hole.

The ring-like locking member 181 is engaged with the locking stepped portion 171 of the sleeve $52_{12}$ fitted in the fitting hole 49 such that the fitting protrusion 189 is fitted in the fitting recess 190. The locking member 181 is fitted into and caulked with the annular locking groove 176 thereby to secure the sleeve $52_{12}$ to the first intake valve side rocker arm $33_1$ in a state where the sleeve $52_{12}$ is prevented from being be rotated around its axis.

Figure 27:
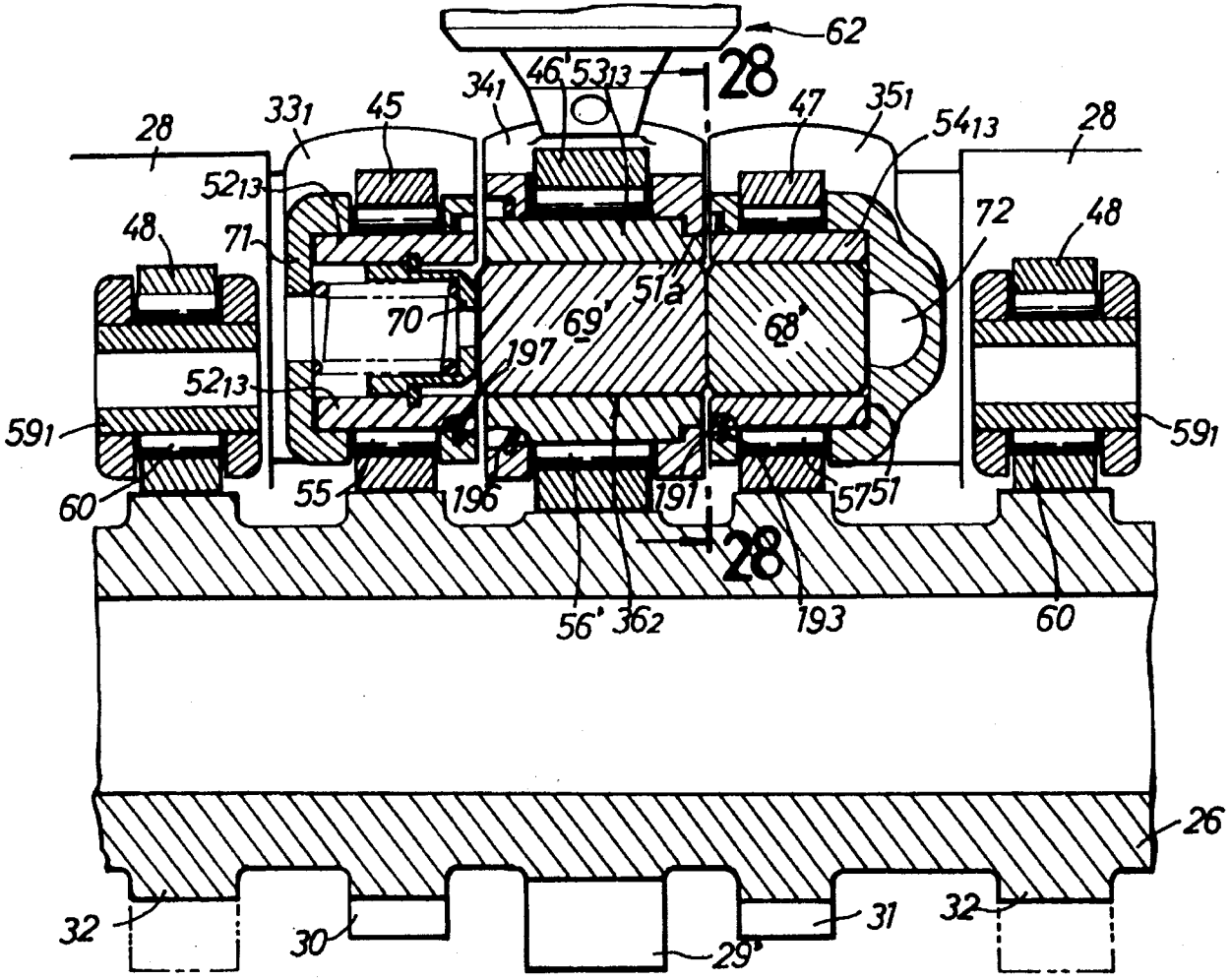
Figure 28:
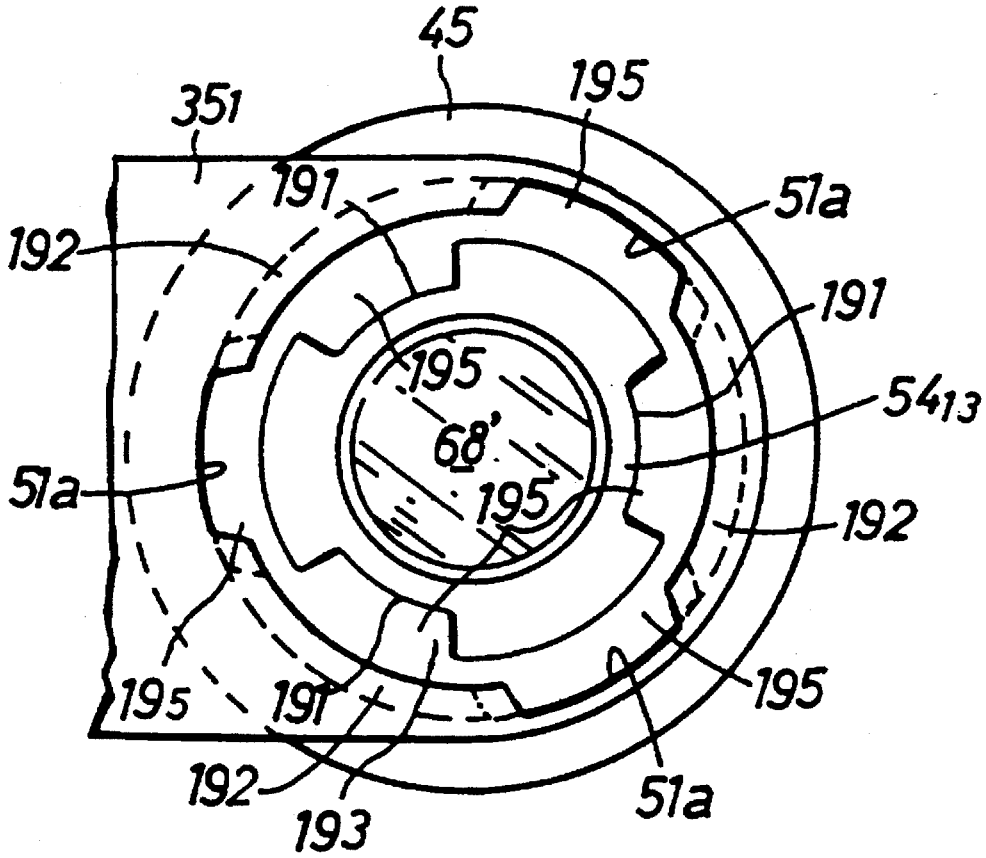
Figure 29:
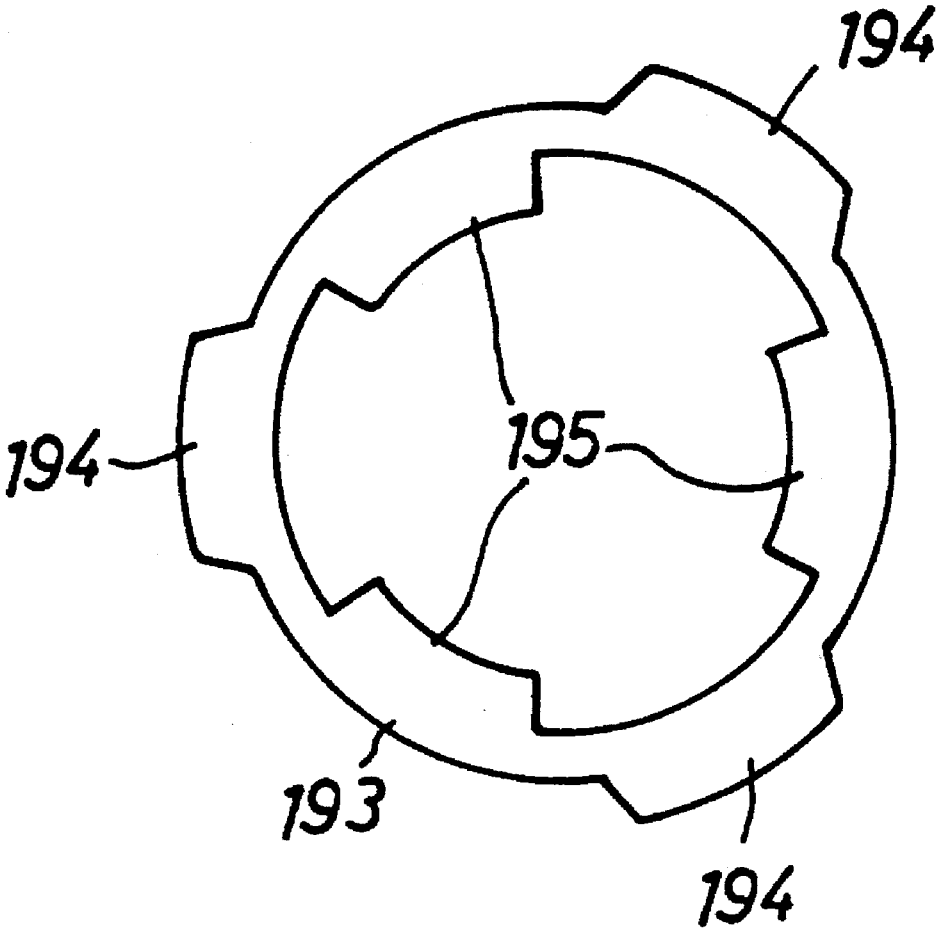

FIGS. 27, 28 and 29 illustrate a thirteenth modified embodiment of the sleeve fixing structure. FIG. 27 is a cross-sectional view, FIG. 28 is a view taken along line 28—28 of FIG. 27, and FIG. 29 is a front view of a locking member.

A sleeve $52_{13}$ is secured to a first intake valve side rocker arm $33_1$. A sleeve $53_{13}$ is secured to a second intake valve side rocker arm $34_1$. A sleeve $54_{13}$ is secured to a third intake valve side rocker arm $35_1$.

A plurality of, for example three, locking grooves 191 are formed at intervals in a circumferential direction on the outer surface of one end of the sleeve $54_{13}$. A plurality of recesses 51*a* facing axially inward is provided at the open end of the bottomed fitting hole 51 provided in the third intake valve side rocker arm $35_1$ such that the sleeve $54_{13}$ is fitted in the open end. Locking collars 192 extending radially inward are provided at a plurality of positions, for example, three positions at intervals in a circumferential direction of the open end of the recess 51*a*.

A ring-like locking member 193 having a sufficient inner diameter so that the sleeve $54_{13}$ can fit therein is contained in the recess 51*a* of the third intake valve side rocker arm $35_1$. Engaging protrusions 194 are projected so as to be disposed between the locking collars 193 around the outer periphery of the locking member 192 when the locking member 193 is contained in the recess 51*a*. Engaging pawls 195 are provided around the inner periphery of the locking member 193 corresponding to the locking grooves 191 provided on the sleeve $54_{13}$.

The engaging protrusions 194 of the locking member 193 are caulked to the locking collars 192 in a state where the locking member 193 is contained in the recess 51*a* of the third intake valve side rocker arm $35_1$ with the sleeve $54_{13}$ being fitted in the fitting hole 51. The connecting pawls 195 are caulked to the locking grooves 191 of the sleeve $54_{13}$ thereby to secure the sleeve $54_{13}$ to the third intake valve side rocker arm $35_1$. The sleeve $54_{13}$ is secured to the second intake valve side rocker arm $34_1$ by using a locking member 196 similar to locking member 193 of the fixing structure for the sleeve $54_{13}$ to the third intake valve side rocker arm $35_1$. Similarly, the sleeve $52_{13}$ is secured to the first intake valve side rocker arm $33_1$ by using a locking member 197.

While the preferred embodiments of the present invention have been shown and described, it is to be understood that these disclosures are for the purpose of illustration and that various changes and modifications may be made without departing from the scope of the invention as set forth in the appended claims.

What is claimed is:

1. An SOHC-type valve operating system in a multiple cylinder internal combustion engine having a single cam shaft extending above the multiple cylinders and commonly provided for a pair of intake valves and a pair of exhaust valves for each cylinder, a plurality of intake valve driving members for each cylinder rockably disposed on an intake rocker arm shaft located between said cam shaft and said pair of intake valves, said plurality of intake valve driving members having cam-side arms extending laterally from said rocker arm shaft toward said cam shaft and valve-side arms extending laterally from said rocker arm shaft toward said pair of intake valves in a direction opposite of said cam-side arms, said plurality of intake valve driving members having an operative-connection switchover mechanism located on an end of said cam-side arms for switching over between a connection and disconnection of said plurality of intake valve driving members, a pair of exhaust valve driving members for each cylinder rockably disposed on an exhaust rocker arm shaft located between said cam shaft and said pair of exhaust valves and independently corresponding to and operating each of said exhaust valves, said intake and exhaust rocker arm shafts being on opposite lateral sides of said single cam shaft, said operative-connection switchover mechanism comprising a switchover pin means movable between a position for operatively connecting adjacent intake valve driving members and a position for releasing such connection for said connection and disconnection of said plurality of intake valve driving members, a cylindrical sleeve means provided in each of said intake valve driving members for guiding the movement of said switchover pin means, at least one of said cylindrical sleeve means rotatably supporting a cylindrical rotor in rolling contact with a cam provided on said cam shaft, and said operative-connection switchover mechanism being disposed at said ends of said cam-side arms of said plurality of intake valve driving members on an opposite side of said intake rocker arm shaft from said pair of intake valves for transmitting intake valve lifting force from said cams to said cam-side arms of said pair of intake valve driving members operatively connected to said pair of intake valves in both said connection and disconnection conditions of said operative-connection switchover mechanism.

2. An SOHC-type valve operating system in an internal combustion engine according to claim 1, wherein said system further comprises a plug pipe in which an ignition plug is to be inserted, said plug pipe being provided in a cylinder head between said pair of intake valves.

3. An SOHC-type valve operating system in an internal combustion engine according to claim 1 or 2, wherein at least one of said plurality of intake valve driving members is free from connection to said intake valves when said operative-connection switchover mechanism is in a state where the operative connection is released, and a lost motion mechanism for resiliently urging said at least one intake valve driving member toward said cam is disposed above and engages said at least-one intake valve driving member.

4. An SOHC-type valve operating system in an internal combustion engine according to claim 2, wherein said plug pipe is located closer to said pair of intake valves than to said intake rocker arm shaft and is inclined relative to said pair of intake valves toward a center of said cylinder.

5. An SOHC-type valve operating system in an internal combustion engine according to claim 1, 2 or 4, wherein said single cam shaft is located substantially equidistant between said intake rocker arm shaft and said exhaust rocker arm shaft.

6. An SOHC-type valve operating system in an internal combustion engine according to claim 1, 2 or 4, wherein said single cam shaft is located substantially on the center lines of the multiple cylinders.

7. An SOHC type valve operating system in an internal combustion engine according to claim 1 or 2, wherein said engine is a V-type internal combustion engine having two banks of said multiple cylinders with an intake port for each bank located between said two banks.

8. An SOHC type valve operating system in an internal combustion engine according to claim 1, wherein at least one of said plurality of intake valve driving members has a cylindrical hole extending parallel to an axis of said intake rocker arm shaft for receiving said cylindrical sleeve means, said cylindrical sleeve means has an outer cylindrical surface with at least two portions with different diameters, one of said portions of the outer cylindrical surface having a largest diameter being press-fitted into a portion of said cylindrical hole for securing said cylindrical sleeve means to said at least one rocker arm.

9. An SOHC type valve operating system in an internal combustion engine according to claim 1, wherein said cylindrical sleeve means and each of said intake valve driving members to which the cylindrical sleeve means is secured have adjacent axially countersunk portions at locations on at least one axial end of said cylindrical sleeve means, and securing means is located in said countersunk portions for securing said cylindrical sleeve means to said associated intake valve driving member, said securing means being comprised of a locking member fitted in a groove provided in one or both of said cylindrical sleeve means and associated intake valve driving member, said locking member engaging both said cylindrical sleeve means and associated intake valve driving member, and wherein said system further includes means for permanently securing said locking member to one or both of said cylindrical sleeve means and associated intake valve driving member.

* * * * *